US007194952B2

(12) United States Patent
Naitou et al.

(10) Patent No.: US 7,194,952 B2
(45) Date of Patent: Mar. 27, 2007

(54) STENCIL PRINTING MACHINE

(75) Inventors: Taku Naitou, Ibaraki-ken (JP); Akira Nakamura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 7 days.

(21) Appl. No.: 10/927,491

(22) Filed: Aug. 27, 2004

(65) Prior Publication Data

US 2005/0217516 A1 Oct. 6, 2005

(30) Foreign Application Priority Data

Apr. 6, 2004 (JP) ..... P2004-111847

(51) Int. Cl.
*B41L 13/06* (2006.01)
*B41L 13/04* (2006.01)
*B41F 15/38* (2006.01)

(52) U.S. Cl. ..... 101/119; 101/116

(58) Field of Classification Search ..... None
See application file for complete search history.

(56) References Cited

U.S. PATENT DOCUMENTS 4,526,098 A * 7/1985 Bachman ..... 101/115
5,617,786 A * 4/1997 Negishi ..... 101/116
6,089,150 A * 7/2000 Uchiyama ..... 101/116
6,789,472 B2 * 9/2004 Nakamura et al. ..... 101/119

FOREIGN PATENT DOCUMENTS

| | | | |
|---|---|---|---|
| DE | 164375 C | | 10/1905 |
| DE | 10232254 A1 | * | 2/2004 |
| JP | 07-132675 | | 5/1995 |
| JP | 2001-246828 | | 9/2001 |
| JP | 2002019250 A | * | 1/2002 |
| JP | 2004/058454 A | * | 2/2004 |

* cited by examiner

*Primary Examiner*—Daniel J. Colilla
(74) *Attorney, Agent, or Firm*—Nath Law Group PLLC; Jerald L. Meyer; Derek Richmond

(57) ABSTRACT

A stencil printing machine includes a rotatable printing drum including an outer peripheral wall of ink impermeable material. A stencil paper is mounted around the surface of the outer peripheral wall. An ink supplying mechanism includes an ink supplying unit in the maximum printing area of the outer peripheral wall of the printing drum and causes ink to be supplied from the ink supplying unit to the surface of the outer peripheral wall. A pressure roller presses a fed print sheet against the outer peripheral wall.

10 Claims, 20 Drawing Sheets

STENCIL PRINTING MACHINE

BACKGROUND OF THE INVENTION

1. Field of the Invention

The present invention relates to a stencil printing machine which transfers ink, transuding out of pores in a stencil paper, onto a print medium by transferring the print medium while pressing the print medium against a printing drum on which the stencil paper is mounted.

2. Description of the Related At

As conventional stencil printing machines, there have been an inner press type (disclosed in Japanese Patent Application Laid-open No. 7-132675) and an outer press type (disclosed in Japanese Patent Application Laid-open No. 2001-246828).

The inner press type will be described briefly as follows. As shown in FIG. 1, a stencil printing machine employing the inner press type is provided with a printing drum 110 and a back press roller 101. The printing drum 100 and the back press roller 101 are arranged in a way that the printing drum and the back press roller are each capable of being rotated, and in a state that parts of the outer peripheral surfaces of the printing drum and the back press roller are made closely adjacent to each other. The outer peripheral surface of the printing drum 100 is provided with a stencil clamping unit 100*a* which clamps an edge of a stencil paper 104. In addition, the outer peripheral wall, except for the stencil clamping unit 100*a*, is flexible and is constructed of an ink permeable screen 102.

The interior of the printing drum 100 is provided with an ink supplying mechanism 105. As shown in FIG. 2, this ink supplying mechanism 105 includes an inner press roller 106 which is an ink supplying roller, and this inner press roller 106 is attached to a roller supporting member 107 in a way that the inner press roller is capable of being rotated. The inner press roller 106 is configured to be capable of providing displacement between a pressing position in which the roller supporting member 107 is being pressed against the inner peripheral surface of the screen 102 by being pushed in a direction indicated with an arrow a in FIG. 2 and a resting position in which the roller supporting member 107 is being separated away from the inner peripheral surface of the screen 102 by being caused to rotate in a direction indicated with an arrow b in FIG. 2. The inner press roller 106 is cause to provide displacement to the pressing position while a print sheet 111 is passing through, and is caused to provide displacement to the resting position while in other conditions. Additionally, the inner press roller has a function of applying printing pressure from the side of the inner peripheral surface of the screen 102.

In addition, the roller supporting member 107 is supported by a supporting stem 108 in a way that the roller supporting member 107 is capable of being pivoted on the supporting stem 108, and is provided with a doctor roller 109 and an operating rod 110. The doctor roller 109 is shaped like a cylinder, and is fixed to the roller supporting member 107 in a position which is proximate to the inner press roller 106. The operating rod 110 is supported by the roller supporting member 107 in a way that the operating rod 110 is capable of being rotated. The operating rod 110 is arranged in an upper space defined with the outer peripheral walls, of the inner press roller 106 and the doctor roller 109, which are proximate to each other. This upper space is supplied with ink 103 from an ink supplying unit which is not illustrated here.

Next, a printing operation will be described briefly in order. A stencil paper 104 in which a perforated image is formed is mounted on the outer peripheral surface of the screen 102. Then, while in a printing mode, the printing drum 100 and the back press roller 101 are caused to rotate in a direction indicated with an arrow in FIG. 1 while being synchronized with each other, and a print sheet 111 is fed between the printing drum 100 and the back press roller 101.

When the print sheet 111 is fed, the inner press roller 106 presses the screen 102, and is caused to rotate in accordance with the printing drum 100 while pressing in such a way. Ink 103 which has come through the gap between the inner press roller 106 and the doctor roller 109 is put on the outer peripheral surface of the inner press roller 106, and the ink 103 put on the surface is supplied into the inner surface of the screen 102 sequentially by the rotation of the inner press roller 106.

Furthermore, when the inner press roller 106 presses the screen 102, this pressure has the screen 102 expand outwards, and thus the screen 102 is caused to be pressed against the back press roller 101. Then, a print sheet 111 which has been transferred between the printing drum 100 and the back press roller 101 is further transferred between the inner press roller 106 and the back press roller 101 while being pressed by the screen 102 and the stencil paper 104. By this pressure, the ink 103 on the screen 102 is transferred, out of pores in the stencil paper 104, onto the print sheet 111. Thus, an inked image is printed onto the print sheet 111.

Thence, the outer press type will be described briefly as follows. As shown in FIG. 3, a stencil printing machine employing the outer press type includes a printing drum 120. The outer peripheral surface of the printing drum 120 is provided with a stencil clamping unit 120*a* which clamps an edge of a stencil paper 104. In addition, the outer peripheral wall 120*b*, except for the stencil clamping unit 120*a*, is constructed of a porous, ink penetrable member (ink permeable member).

The interior of the printing drum 120 is provided with an ink supplying mechanism 125. This ink supplying mechanism 125 includes: a squeegee roller 126 which is supported so as to be capable of being rotated; and a doctor roller 127 which is arranged in a way that the doctor roller 127 is proximate to the squeegee roller 126. Ink 128 is pooled in an outer space which is surrounded by the squeegee roller 126 and the doctor roller 127. Ink 128 which is put on the outer periphery of the rotating squeegee roller 126 comes through the interval between the squeegee roller 126 and the doctor roller 127, when thus only a prescribed thickness of ink 128 is put on the squeegee roller 126. Then, this prescribed thickness of ink 128 is supplied into the inside of the outer peripheral wall 120*b* of the printing drum 120.

A pressure roller 130 is arranged in a position which is opposite to the squeegee roller 126, and which is outside the printing drum 120. The pressure roller 130 is configured to be capable of providing displacement between a pressing position in which the pressure roller 130 is being pressed against the outer peripheral wall 120*b* of the printing drum 120 and a resting position in which the pressure roller 130 is being separated away from the outer peripheral wall 120*b* of the printing drum 120. The squeegee roller 126 is fixed to a supporting unit which supports the outer peripheral wall 120*b* of the printing drum 120 in a way that the outer peripheral wall 120*b* of the printing drum 120 is capable of being rotated. While in a state that the outer peripheral wall 120*b* of the printing drum 120 is not pressed by the pressure roller 130, the outer peripheral surface of the squeegee roller 126 and the inner peripheral surface of the outer peripheral wall 120*b* of the printing drum 120 are being slightly separated away. When the outer peripheral wall 120*b* of the printing drum 120 is pressed by the pressure roller 130, the outer peripheral wall 120*b* of the printing drum 120 is caused to bend so that the outer peripheral surface of the squeegee roller 126 and the inner peripheral surface of the outer peripheral wall 120*b* of the printing drum 120 are brought into contact with each other.

Next, a printing operation will be described briefly in order. A stencil paper 104 in which a perforated image is formed is mounted on the our peripheral surface of the outer peripheral wall 120*b* of the printing drum. While in a printing mode, the outer peripheral wall 120*b* of the printing drum 120 is caused to rotate in a direction indicated with an arrow in FIG. 3. Hereby, a print sheet 111 is fed between the printing drum 120 and the pressure roller 130.

When the print sheet 111 is fed, the pressure roller 130 presses the outer peripheral wall 120*b* of the printing drum 120, and hereby the outer peripheral wall 120*b* is caused to provide displacement inwards. This displacement causes the outer peripheral wall 120*b* to be pressed against the squeegee roller 126, and hereby the squeegee roller 126 is caused to rotate in accordance with the printing drum 120. Ink 128 which has come through the gap between the squeegee roller 126 and the doctor roller 127 is put on the outer peripheral surface of the squeegee roller 126, and the ink 128 put on the surface is supplied into the inner surface of the outer peripheral wall 120*b* sequentially by the rotation of the squeegee roller 126.

Furthermore, when the pressure roller 130 presses the outer peripheral wall 120*b* of the printing drum 120, a print sheet 111 which has been transferred between the printing drum 120 and the pressure roller 130 is further transferred between the squeegee roller 126 and the pressure roller 130 while being pressed by the stencil paper 104. By this pressure, ink 128 on the outer peripheral wall 120*b* is transferred, out of pores in the stencil paper 104, onto the print sheet 111. Thus, an inked image is printed onto the print sheet 111.

With regard to the stencil printing machines employing the above described, conventional inner and outer press types, however, ink pools are constructed in an outer peripheral space between the inner press roller 106 and the doctor roller 109, and in an outer peripheral space between the squeegee roller 126 and the doctor roller 127. Ink 103 and ink 128 in the ink pools are supplied respectively to the screen 102 of the printing drums 100 and to the outer peripheral wall 120*b* of the printing drum 120, while a printing operation is performed. As a consequence, in a case that the printing is not performed for a long time, ink 103 and ink 128 held in the respective ink pools as well as ink 103 and 128 put on the printing drums 100 and 120 are left exposed to the atmosphere for a long time. Accordingly, this causes a problem of letting ink change in quality.

In addition, various rollers and the like for supplying ink need to be arranged in the interiors of the printing drums 100 and 120. This causes a problem of making it difficult to miniaturize, and to reduce the weight of, the printing drum 100 and 120.

SUMMARY OF THE INVENTION

The object of the present invention is to provide a stencil printing machine whose ink does not change in quality even if a printing is not performed for a long time, and whose printing drum can be miniaturized and the weight can be reduced.

The stencil printing machine according to the present invention comprises: a rotatable printing drum including an outer peripheral wall formed of ink impermeable material, wherein a stencil paper is mounted around the surface of the outer peripheral wall; an ink supplying mechanism including an ink supplying unit in a maximum printing area of the outer peripheral wall of this printing drum, configured to supply ink from the ink supplying unit to the surface of the outer peripheral wall; and a pressure roller configure to press the fed print medium against the outer peripheral wall.

According to this stencil printing machine, when the printing drum is rotated, and when a print medium is fed in a state that the surface of the outer peripheral wall is supplied with ink from the ink supplying unit, this print medium is transferred while being pressed against a stencil paper and the outer peripheral wall of the printing drum by the pressure roller. On the other hand, the pressure by the pressure roller causes ink between the outer peripheral wall of the printing drum and the stencil paper to be dispersed downstream in the printing direction while being squeezed. The dispersed ink transudes out of pores in the stencil paper, and is transferred onto the print medium, and thus an ink image is printed onto the print medium. Ink which has been supplied to the printing drum is held in a substantially airtight space between the outer peripheral wall of the printing drum and the stencil paper, and the exposure of the ink to the atmosphere is minimized. In addition, various rollers for supplying ink need not be arranged in the interior of the printing drum. As a consequence, ink does not change in quality even if a printing is not performed for a long time, and the printing drum can be miniaturized, and the weight can be reduced. Furthermore, since the ink supplying unit is arranged in the maximum printing area of the outer peripheral wall of the printing drum, an area for arranging the ink supplying unit need not be additionally assigned outside the maximum printing area. This contributes to the miniaturizing of the printing drum.

According to a preferable embodiment of the present invention, the ink supplying unit may be arranged in a most upstream position of the printing in the maximum printing area of the outer peripheral wall. The ink supplying unit may be arranged in the outer peripheral wall in the direction orthogonal to the printing direction and hereby may supply ink almost evenly in the direction orthogonal to the printing direction.

According to this stencil printing machine, while ink is dispersed downstream in the printing direction by the pressure of the pressure roller, the ink is evenly dispersed in the direction orthogonal to the printing direction. As a consequence, unevenness of print concentration in the direction orthogonal to the printing direction can be surely prevented.

In addition, the above described ink supplying unit may be arranged in the vicinity of both side edges of the maximum printing area on the outer peripheral wall of the printing drum.

According to this stencil printing machines, while ink is being squeezed downstream by the pressure roller, part of the ink is squeezed out of the maximum printing area rightwards and leftwards, and in some case an amount of ink goes insufficient on both right and left edges as the ink is squeezed downstream further and further in the maximum printing area. Since, however, ink is additionally supplied from the vicinity of both side edges of a downstream in the printing direction, in no case does ink go insufficient in the vicinity of both side edges of the downstream in the printing direction. Accordingly, unevenness of print concentration in the direction orthogonal to the printing direction can be surely prevented.

The above described ink supplying unit may be arranged on the upstream position in each of a plurality of blocks on the outer peripheral wall of the printing drum, the blocks obtained by dividing the maximum printing area on a downstream of the printing direction.

According to this stencil printing machine, since the ink supplying unit of each block can supply an amount of ink which is used for the block instead of an amount of ink which is used for the overall printing area, a lump of ink can be minimized even if the lump of ink is formed between the stencil paper and the outer peripheral wall while the ink is being squeezed by the pressure roller. Accordingly, load cast on the stencil paper can be reduced, and the durability of the stencil paper against repeated printing can be improved.

Grooves for preventing ink leak may be arranged on the outer peripheral wall, outside the maximum printing area and in a place which is covered by a stencil paper. According to this stencil printing machine, if ink between the outer peripheral wall and the stencil paper leaks out of the maximum printing area, the leaked ink flows into the grooves for preventing ink leak. Accordingly, ink can be surely prevented from leaking out from edges of the stencil paper.

Further an ink recovering mechanism may be arranged for recovering ink leaked out of the maximum printing area of the outer peripheral wall. According to this stencil printing machine, an excessive amount of ink is removed from the outer peripheral wall of the printing drum, and concurrently can be recycled.

The ink recovering mechanism may recover ink accumulated in the groove for preventing ink leak, it also serves for the object of the embodiment. According to this stencil printing machine, ink which accumulates in the grooves for preventing ink leak can be surely removed. In addition, a situation in which ink overflows from the groove for preventing ink leak can be avoided, and concurrently ink can be recycled.

It should be noted that, in this specification, the most upstream position in the maximum printing area in which the ink supplying unit is arranged means a concept, literally including the most upstream position of the printing in the maximum printing area, and also including the position on the border line which sections the maximum printing area off the further upstream area onto which a printing is not made. In addition, the most upstream position of the printing in the maximum printing area in which the ink supplying unit is arranged is defined, specifically, as a range in which ink that is supplied to the surface of the outer peripheral wall can be dispersed at least towards the border line that sections the maximum printing area off the further upstream area onto which a printing is not made.

DETAILED DESCRIPTION OF THE PREFERRED EMBODIMENT

An embodiment of the present invention will be described hereinafter with reference to the accompanying drawings.

Figure 1:
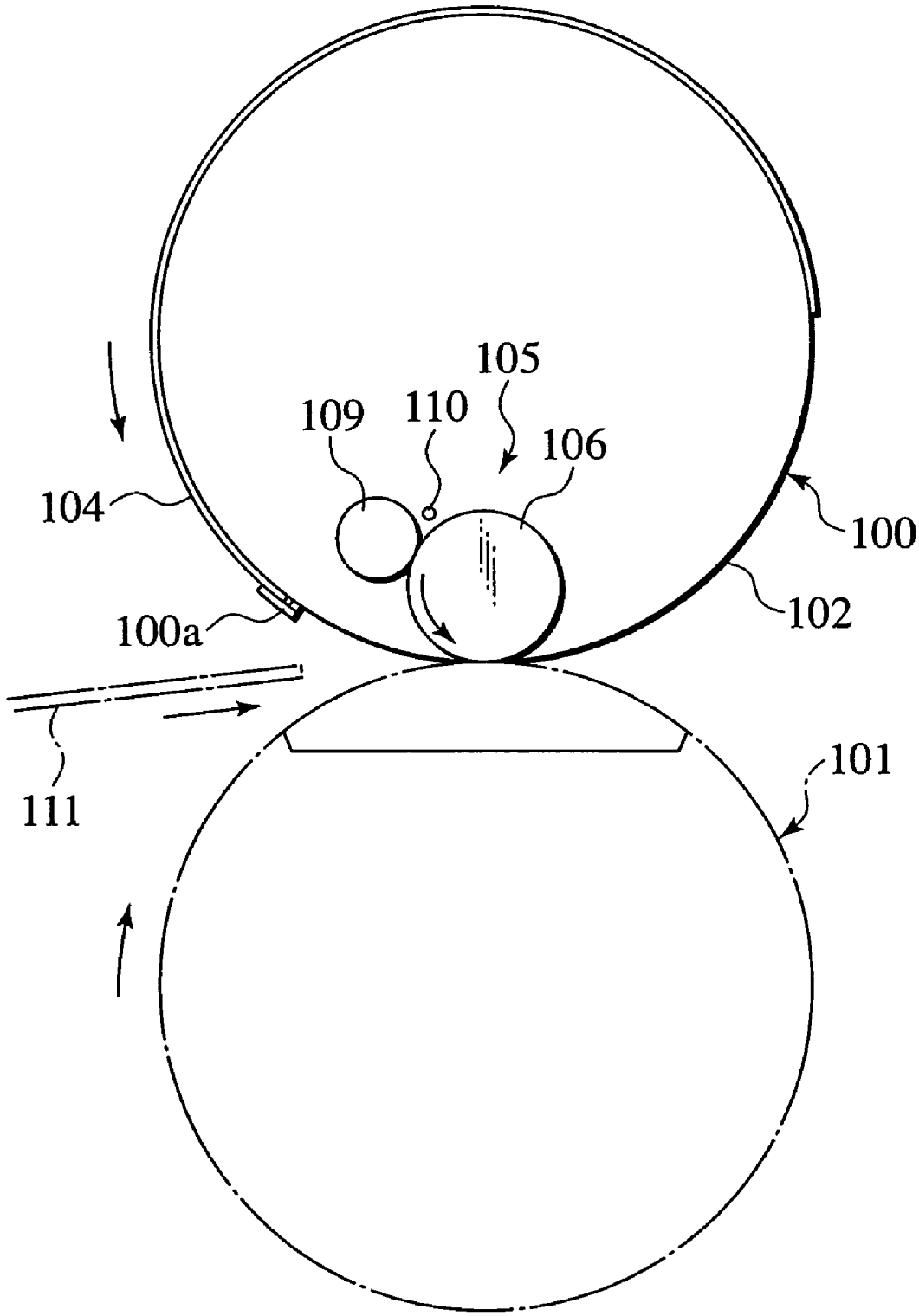
FIG.1 PRIOR ART
FIG. 1 is a diagrammatic view of a chief printing section employing an inner press type according to a conventional example.
Figure 2:
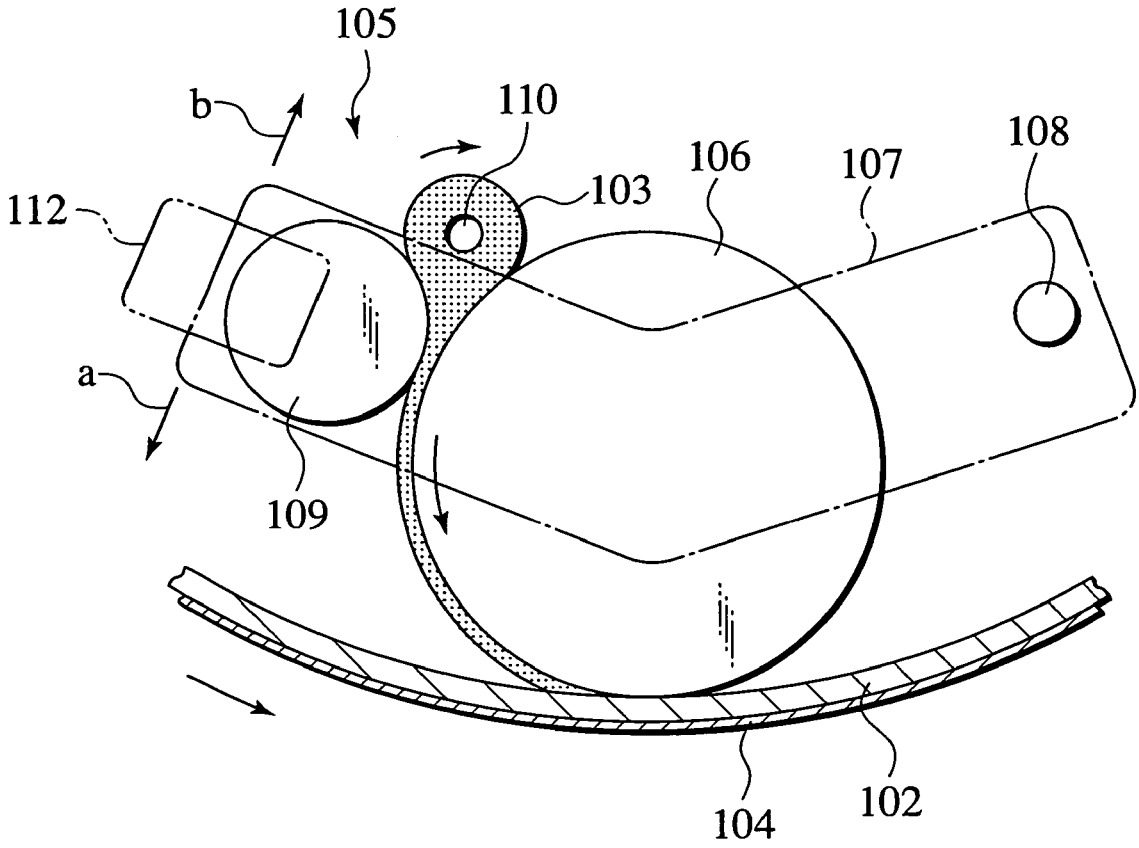
FIG.2 PRIOR ART
FIG. 2 is a diagrammatic view of an ink supplying mechanism employing the inner press type according to the conventional example.
Figure 3:
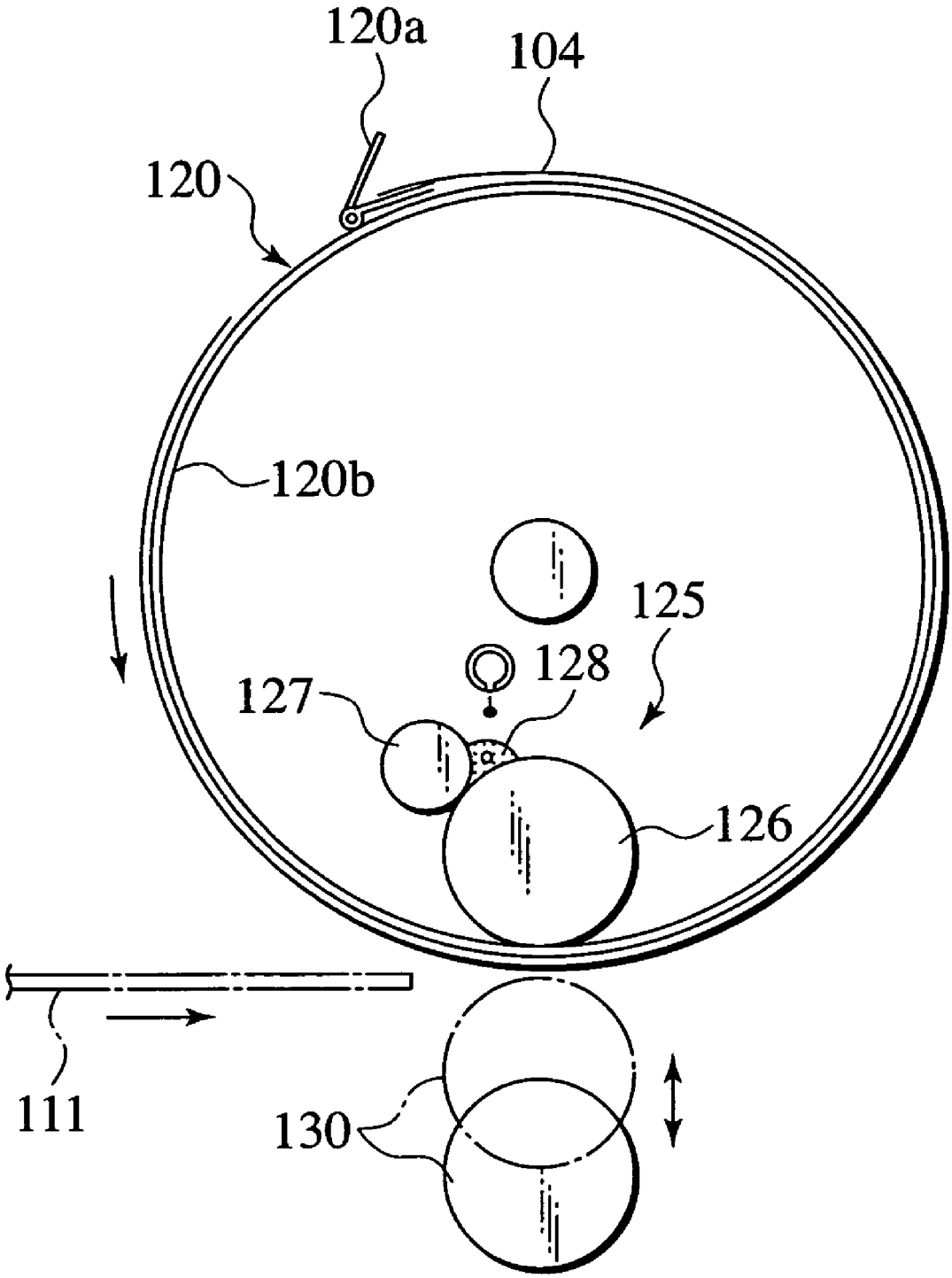
FIG.3 PRIOR ART
FIG. 3 is a diagrammatic view of a chief printing section employing an outer press type according to the conventional example.
Figure 4:
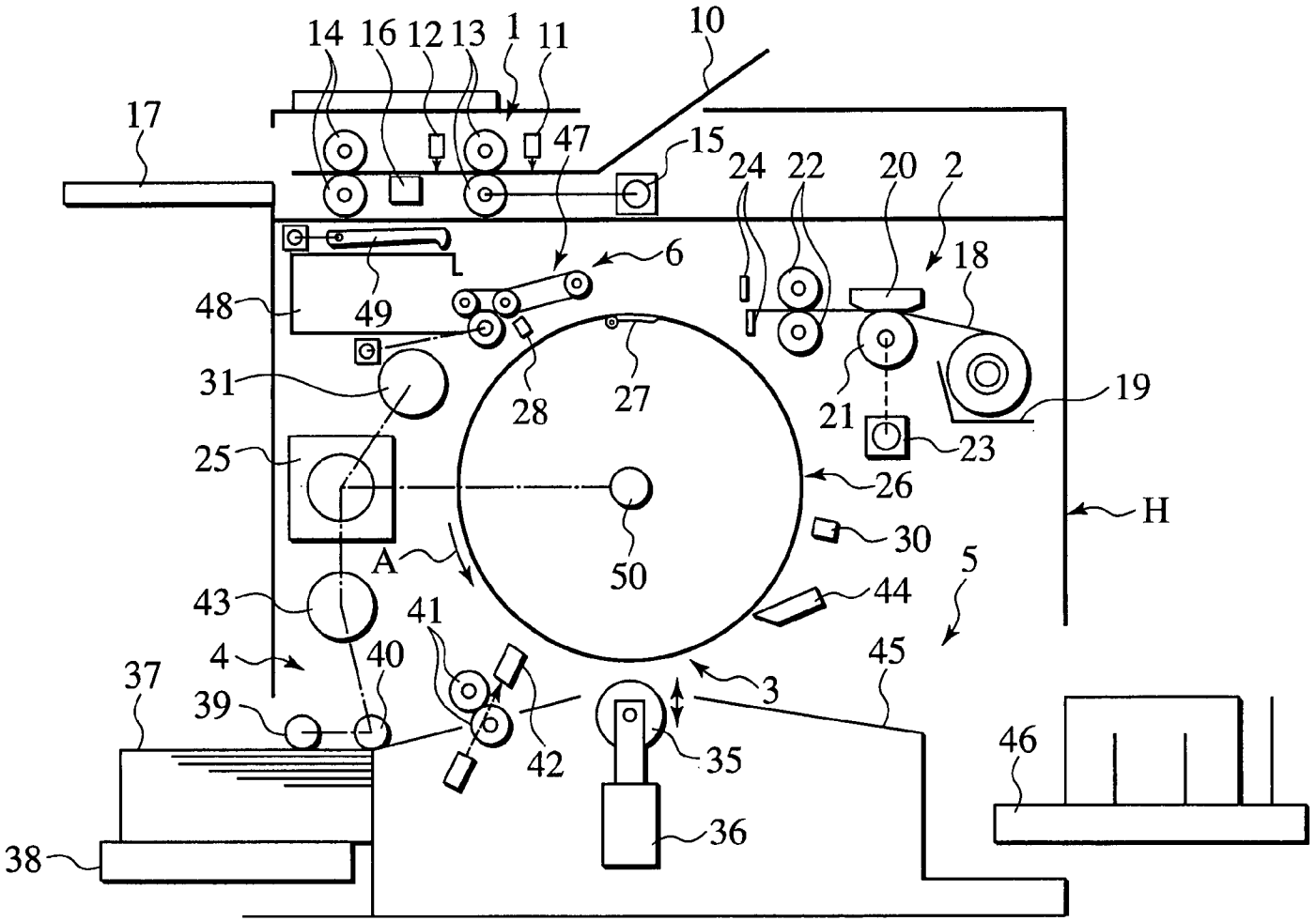
FIG. 4 is a schematic block diagram of a stencil printing machine to show a first embodiment of the present invention.

As shown in FIG. 4, a stencil printing machine is provided with an original acquiring unit 1, a stencil making unit 2, a printing unit 3, a paper feeding unit 4, a paper discharging unit 5, and a stencil discharging unit 6.

The original acquiring unit 1 comprises: an original setup rack 10 on which an original to be printed is loaded; original detection sensors of a reflective type 11 and 12 for checking whether or not the original is on the original setup rack 10; original leading rollers 13 and 14 for transferring the original which has been loaded on the setup rack 10; a stepping motor 15 for causing the original leading rollers 13 and 14 to be driven and rotated; an image sensor of a contact type 16 for optically acquiring image data of the original to be transferred by the original leading rollers 13 and 14, and for converting the image data into electric signals; and an original discharging tray 17 on which an original to be discharged from the original setup rack 10 is loaded. In addition, the original which has been loaded on the original setup rack 10 is transferred by the original leading rollers 13 and 14, and the image data of the original thus transferred is acquired by the image sensor 16.

The stencil making unit 2 comprises: an original containing unit 19 which contains a roll of a long stencil paper 18; a thermal print head 20 which is arranged downstream of transferring from the original containing unit 19; a platen roller 21 which is arranged in a place opposite to the thermal print head 20; a pair of stencil transferring rollers 22 and 22 which are arranged downstream of transferring from the platen roller 21 and the thermal print head 20; a light pulse motor 23 for causing the platen roller 21 and the pair of stencil transferring rollers 22 and 22 to be driven and rotated; and a stencil cutter 24 which is arranged downstream of transferring from the pair of stencil transferring rollers 22 and 22.

In addition, the long stencil paper 18 is transferred by the rotations of the platen roller 21 and the stencil transferring rollers 22 and 22, and the stencil paper 18 is perforated according to heat sensitiveness in a way that each of dotted heat generators of the thermal print head 20 performs a selective operation of generating heat based on the image data acquired by the image sensor 16. Accordingly, a stencil paper 18 is made. The stencil paper 18 thus made is cut, by a stencil cutter 24, into a stencil paper 18 of a prescribed length.

The printing unit 3 comprises: a printing drum 26 which is caused by a driving force of a main motor 25 to be rotated in the direction indicated by an arrow A in FIG. 4; a stencil clamping unit 27, installed onto the outer peripheral surface of the printing drum, for clamping the edge of the stencil paper 18; a stencil loading sensor 28 for checking whether or not the stencil paper 18 is wound around, and mounted on, the outer peripheral surface of the printing drum 26; a reference position detecting senor 30 for detecting the reference position of the printing drum 26; and a rotary encoder 31 for detecting the revolution of the main motor 25. The rotating position of the printing drum 26 is configured to be enabled to be detected by detecting an output pulse of the rotary encoder 31 based on an output detected by the reference position detecting sensor 30.

Further, the printing unit 3 comprises a pressure roller 35 which is arranged in a place below the printing drum 26. The pressure roller 35 is configured to be capable of providing displacement between a pressing position where the pressure roller is pressed against the outer peripheral surface of the printing drum 26 by a driving force caused by a solenoid device 36 and a resting position where the pressure roller is separated away from the outer peripheral surface of the printing drum 26. The pressure roller 35 is always positioned in the pressing position during the period of being in a printing mode (including a trial print mode), and is positioned in the resting position during the period of being in a mode other than the printing mode.

The edge of the stencil paper 18 to be transferred from the stencil making unit 2 is clamped by the stencil clamping unit 27, and the stencil paper 18 is wound around, and mounted on, the outer peripheral surface of the printing drum 26 by rotating the printing drum 26 in a state that the edge of the stencil paper is clamped. Afterwards, the print sheet 37 (i.e. a print medium) to be fed from the paper feeding unit 4 while being synchronized with the rotation of the printing drum 26 is pressed by the pressure roller 35 against the stencil paper 18 which has been wound around the printing drum 26. By this, an image is printed in a way that ink 56 out of the pores in the stencil paper 18 is transferred onto the print sheet 37.

The paper feeding unit 4 comprises: a paper feed tray 38 on which print sheets 37 are laid in a stack; primary paper feeding rollers 39 and 40 which feed from the paper feed tray 38 only a print sheet 37 that is located at the top of the stack; a pair of secondary paper feeding roller 41 and 41 that load the print sheet 37, which has been fed by the primary paper feeding rollers 39 and 40, between the printing drum 26 and the pressure roller 35 while being synchronized with the rotation of the printing drum 26; and a paper detection sensor 42 for checking whether or not the print sheet 37 has been loaded between the pair of secondary paper feeding rollers 41 and 41. The primary paper feeding rollers 39 and 40 are configured in a way that the revolution of the main motor 25 is selectively transmitted to the primary paper feeding rollers 39 and 40 through a paper feeding clutch 43.

The paper discharging unit 5 comprises: a paper separator 44 for separating a print sheet 37, which has been processed for printing, from the printing drum 26; a transferring passage 45 in which the print sheet 37 which has been separated away from the printing drum 26 by the paper separator 44 is transferred; and a paper receiving tray 46 on which the print sheet 37 that has been discharged from the transferring passage 45 is loaded.

The stencil discharging unit 6 comprises: a discharged stencil transferring unit 47 for guiding the edge of the stencil paper 18, which has been released from a state of being clamped to the outer peripheral surface of the printing drum 26, and for transferring the used stencil paper thus guided while separating the used stencil paper from the printing drum 26; a stencil disposal box 48 for containing the stencil paper 18 which has been transferred by the discharged stencil transferring unit 47; and a discharged stencil paper compressing member 49 for pressing into the back of the stencil disposal box 48 the stencil paper 18 which has been transferred to the inside of the stencil disposal box 48 by the discharged stencil transferring unit 47.

Figure 5:
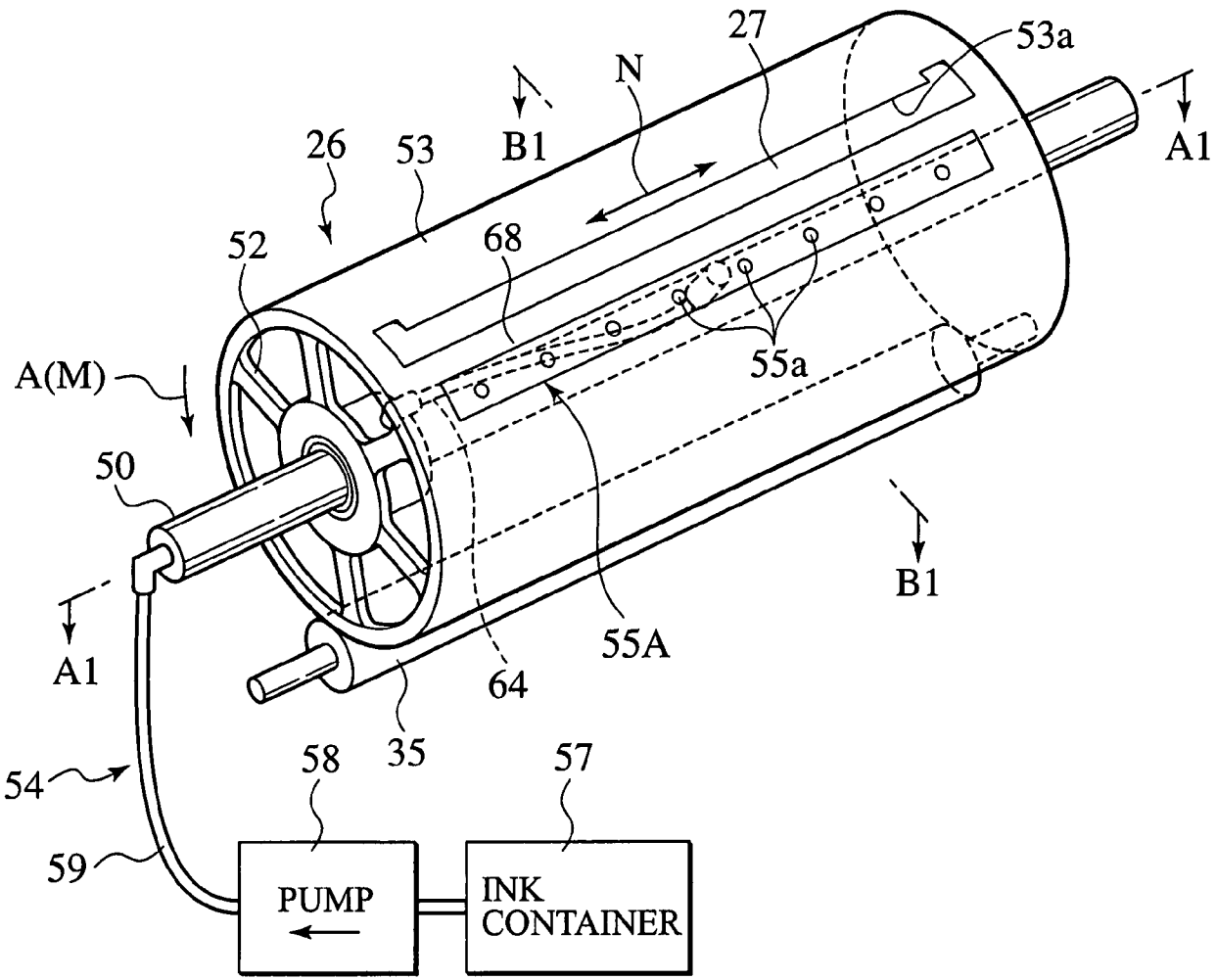
FIG. 5 is a perspective view of a printing drum to show the first embodiment of the present invention.
Figure 6:
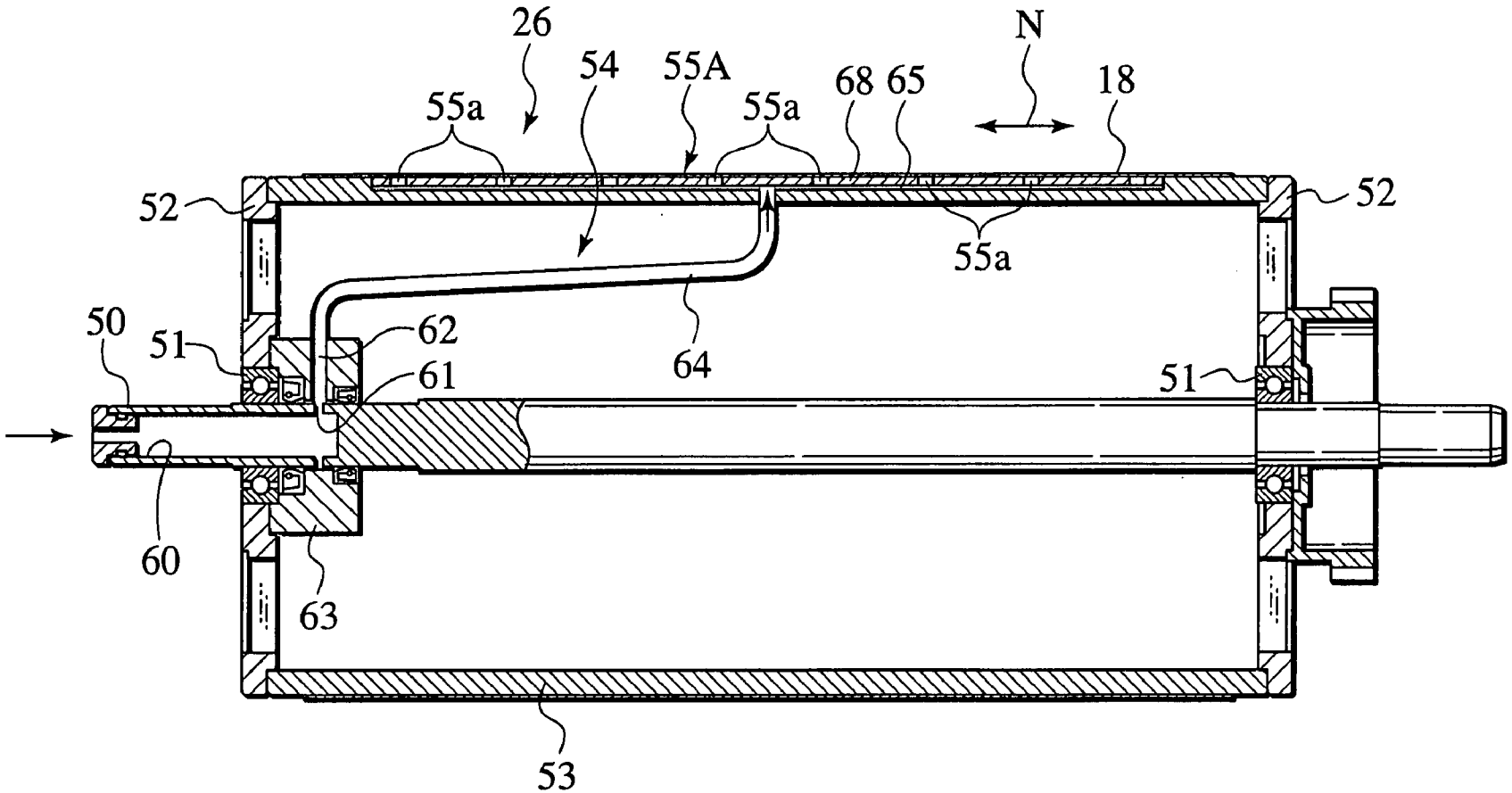
FIG. 6 is a cross sectional view taken along the line 6—6 of FIG. 5 to show the first embodiment of the present invention.
Figure 7:
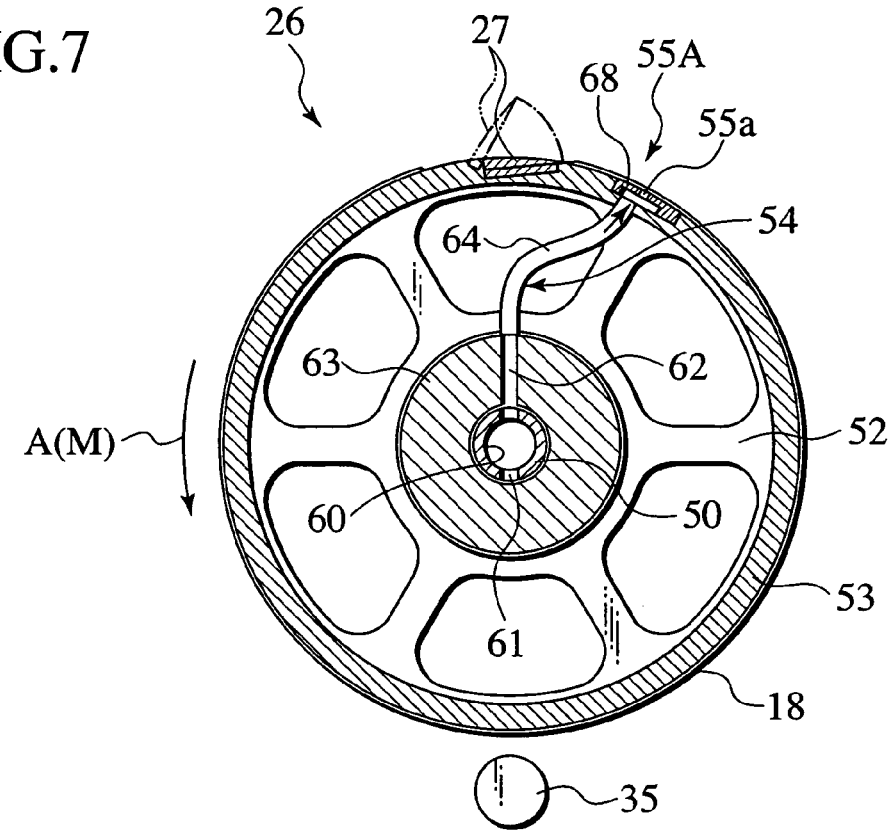
FIG. 7 is a cross sectional view taken along the line 7—7 of FIG. 5 to show the first embodiment of the present invention.

As shown in FIG. 5 to FIG. 7, the printing drum 26 comprises: a main shaft 50 which is fixed to the main body H of the stencil printing machine (illustrated in FIG. 4); a pair of side discs 52 and 52 which are supported by the main shaft 50 so as to be capable of being rotated while respectively riding on bearings 51; and an outer peripheral wall 53, shaped like a cylinder, which is fixed in-between the pair of side discs 52 and 52. This outer peripheral wall 53 is configured to be integrated with the pair of side discs 52 and 52, and to be driven and rotated by a revolving force of the main motor 25. In addition, the outer peripheral wall 53 is made of ink impermeable material which is so rigid as not to be deformed when being pressed against the pressure roller 35, and which does not allow ink 56 to permeate through. Furthermore, depending on kinds of ink impermeable material, the outer peripheral surface of the outer peripheral wall 53 may be coated with fluorine contained resin such as Teflon (a registered trade mark), or plated with nickel, nickel-chromium or molten zinc, or subjected to anodic oxidation or other publicly known surface processing in order to shape the outer peripheral surface of the outer peripheral wall 53 into a cylinder whose surface has no dent or bump.

The stencil clamping unit 27 is provided to a concave portion 53*a* for the clamping, which is formed in the axial direction of the main shaft 50 of the outer peripheral wall 53. With regard to the stencil clamping unit 27, one end thereof is supported by the outer peripheral wall 53 so as to be capable of being rotated, and sticks out of the outer peripheral wall 53 while being released from a state of being clamped, which is indicated with imaginary lines in FIG. 7. The end is configured so that the end does not stick out of the outer peripheral wall 53 while in a state of being clamped, which is indicated with solid lines in FIG. 7. As a consequence, the stencil clamping unit 27 is configured so that the stencil clamping unit can clamp the stencil paper 18 without sticking out of the outer peripheral wall 53.

This outer peripheral wall 53 is caused to be rotated in the direction indicated with an arrow A(M) in FIG. 5 and FIG. 7, and a position where the outer peripheral wall rotates a little away from the stencil clamping unit 27 is defined as the point from which the printing is started. Accordingly, the direction A of the rotation becomes equivalent to the direction M of the printing, and an area below the point from which the printing is started is assigned as a printing area. In this first embodiment of the present invention, the maximum printing area S (shown in FIG. 9) is set up in an area in which an A3 sized sheet can be printed. In addition, an ink supplying unit 55A of an ink supplying mechanism 54 is provided on a place which is in the maximum printing area S, and which is on the most upstream of the maximum printing area in the printing direction M.

A shown in FIG. 5 to FIG. 9, the ink supplying mechanism 54 comprises: an ink container 57 for containing ink 56; an inking pump 58 for sucking up the ink 56 which is contained in the ink container 57; a first pipe 59 for supplying the ink 56 which has been sucked up by the inking pump 58; the main shaft 50, which one end of the first pipe 59 is connected to, which an ink passage 60 is formed in, and where a hole 61 is formed in a place diametrically opposite; a rotary joint 63, which is supported by the outer periphery of the main shaft 50 so as to be capable of being rotated, and where a communicating hole 62 that can communicate with the hole 61 is formed; a second pipe 64, one end of which is connected to the rotary joint 63, and the other end of which is guided to the outer peripheral wall 53; and an ink supplying unit 55A to which the other end of the second pipe 64 is open. The ink passage 60, the hole 61, 62 and the second pipe 64 constitute a conduit for supplying ink to the ink supplying unit 55A from the inside of the printing drum 26 without exposing the ink to the atmosphere. The ink supplying unit 55A is configured to supply ink from the second pipe 64 into a space between the stencil paper 18 and the outer peripheral wall 53 of the printing drum 26 without exposing the ink to the atmosphere.

Figure 8:
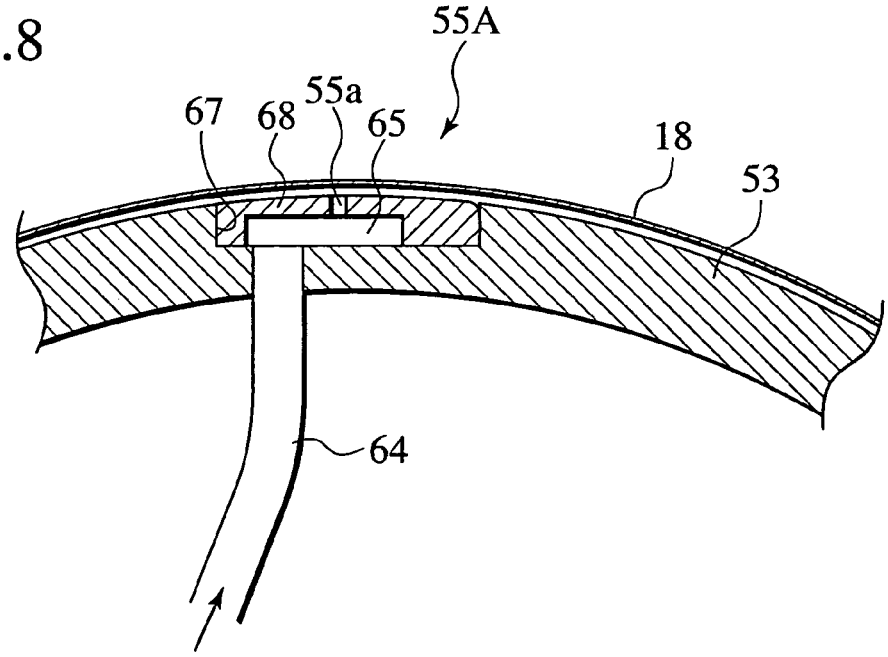
FIG. 8 is a magnified, cross sectional view of the vicinity of an ink supplying unit to show the first embodiment of the present invention.

The ink supplying unit 55A comprises: an ink dispersing groove 65 for dispersing the ink 56, which comes from the second pipe 64, in the direction N orthogonal to the printing direction M; and a plurality of ink supplying outlets 55*a* as ink dispersing/supplying units, the ink supplying outlets 55*a* being arrayed at equal intervals in the direction N orthogonal to the printing direction M, each of which has an opening towards the ink dispersing groove 65 at one end, and each of which has an opening towards the surface of the outer peripheral wall 53 at the other end. As shown in FIG. 8, the ink dispersing groove 65 and the plurality of ink supplying outlets 55*a* are configured of; a concave portion 67 for supplying ink which is formed in the outer peripheral wall 53 in the direction N orthogonal to the printing direction M; and an ink distributing member 68 which is arranged in the concave portion 67 for supplying ink. The ink supplying outlets 55*a* are arrayed in the direction N orthogonal to the printing direction M, and are configured to supply ink 56 onto the outer peripheral wall 53 almost evenly in the direction N orthogonal to the printing direction M.

Figure 9:
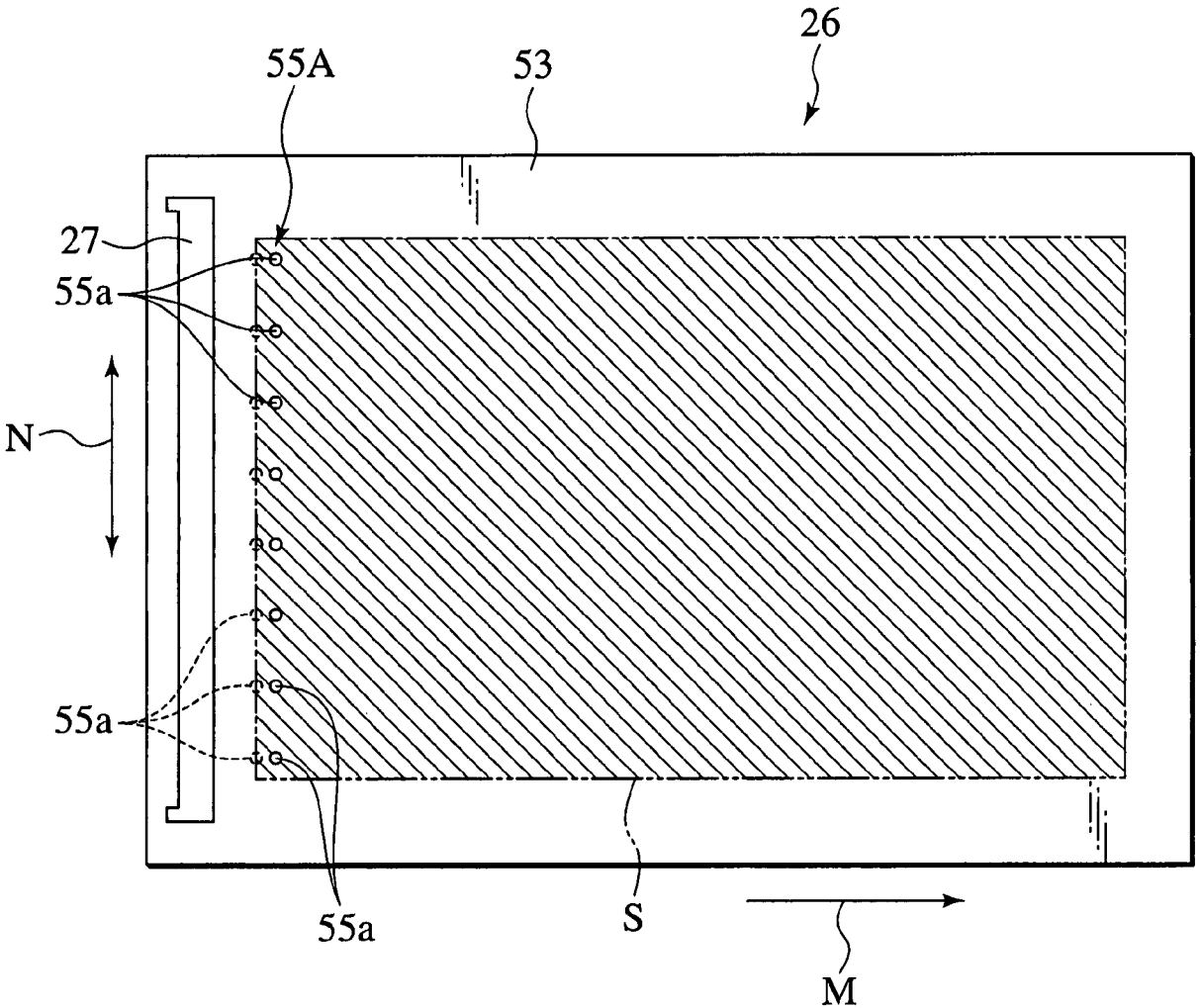
FIG. 9 is an expanded view of an outer peripheral wall of a printing drum to show the first embodiment of the present invention.

In this embodiment, the most upstream position of the printing in the maximum printing area S in which the ink supplying unit 55A is arranged means a concept, literally including the most upstream position of the printing in the maximum printing area S (the position in which the ink supplying outlets 55*a* are illustrated with solid lines in FIG. 9), and also including a position on the border line which sections the maximum printing area S off the further upstream area onto which a printing is not made (a position in which the ink supplying outlets 55*a* are illustrated with broken lines in FIG. 9). In addition, the most upstream position of the printing in the maximum printing area S in which the ink supplying units 55*a* are provided is defined, specifically, as a range in which ink that is supplied to the surface of the outer peripheral wall 53 can be dispersed at least towards the border line that sections the maximum printing area S off the further upstream area onto which a printing is not made.

Next, operations of the stencil printing machine with the above described configuration will be explained briefly.

First, when a mode of making a stencil is chosen, the stencil making unit 2 loads the stencil paper 18 by the rotations of the platen roller 21 and the stencil loading roller 22. The stencil is prepared by perforating the stencil paper 18 according to heat sensitiveness in a way that a plurality of heat generators of the thermal print head 20 performs a selective operation of generating heat based on image date acquired by the original acquiring unit 1. The prepared stencil paper 18 is cut at prescribed places by the stencil cutter 24, and accordingly is made into a stencil paper 18 in required measurements.

The printing unit 3 clamps the extremity of the stencil paper 18, which has been prepared by the stencil making unit 2, by the stencil clamping unit 27 of the printing drum 26. The printing unit 3 mounts the stencil paper 18 on the printing drum 26 through winding the stencil paper 18 around the outer peripheral surface of the printing drum 26 by causing the printing drum 26 to be rotated while in a state that the stencil paper is clamped.

Next, when a printing mode is chosen, the printing unit 3 causes the printing drum 26 to be driven and rotated, and concurrently causes the operation of the ink supplying mechanism 54 to be started. Then, the ink 56 is supplied from the ink supplying outlets 55*a* to the outer peripheral wall 53. The supplied ink 56 is held between the outer peripheral wall 53 and the stencil paper 18, and concurrently the pressure roller 35 is caused to provide displacement from the resting position to the pressing position.

The paper feeding unit 4 feeds a print sheet 37 between the printing drum 26 and the pressure roller 35, while being synchronized with the rotation of the printing drum 26. The fed print sheet 37 is pressed against the outer peripheral wall 53 of the printing drum 26 by the pressure roller 35, and concurrently is transferred by the rotation of the outer peripheral wall 53 of the printing drum 26. In other words, the print sheet 37 is transferred while being brought into contact with the stencil paper 18.

Figure 10:
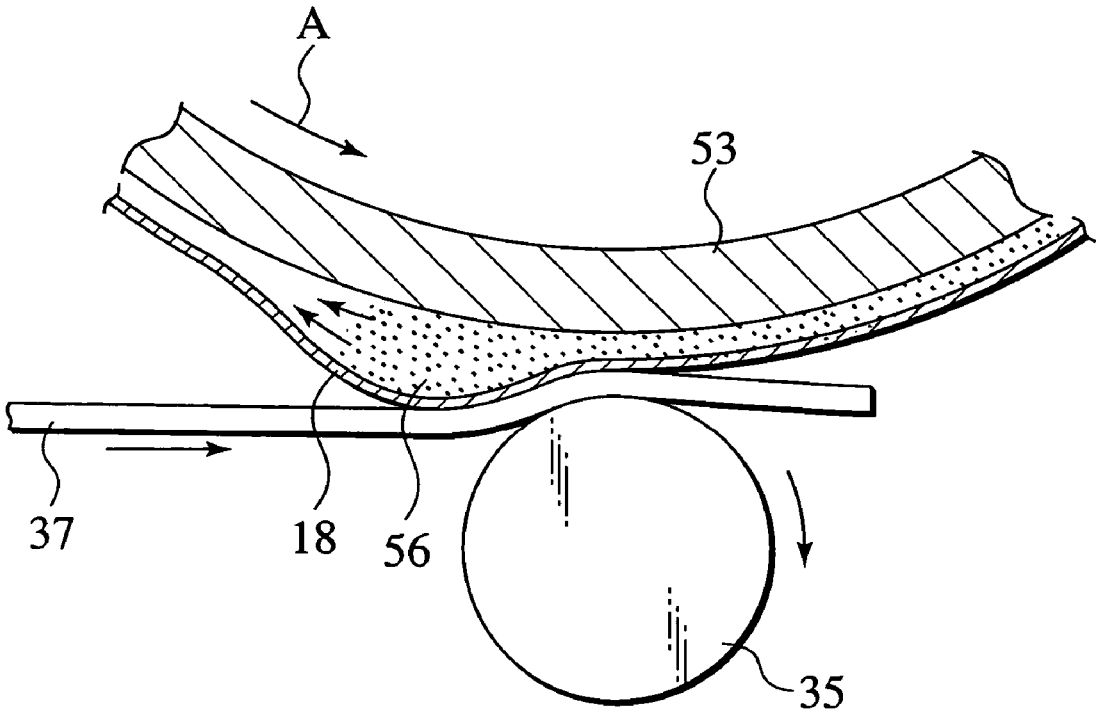
FIG. 10 is a partial cross sectional view to describe a mechanism of dispersing ink and to show the first embodiment of the present invention.

In addition, in concurrence with the transferring of the print sheet 37, as shown in FIG. 10, ink 56 held between the outer peripheral wall 53 of the printing drum 26 and the stencil paper 18 is dispersed downstream in the printing direction M while being squeezed by the pressure caused by the pressure roller 35. Accordingly, the dispersed ink 56 transudes out of pores in the stencil paper 18, and is transferred onto the print sheet 37. In the above described way, an inked image is printed onto the print sheet 37 while in the process of being passing between the outer peripheral wall 53 of the printing drum 26 and the pressure roller 35. With regard to the print sheet 37 which has come out between the outer peripheral wall 53 of the printing drum 26 and the pressure roller 35, the extremity thereof is taken off the printing drum 26 by a sheet separator 44. The print sheet 37 which has been separated away from the printing drum 26 is discharged onto a paper receiving tray 46 through a transferring passage 45, and is laid thereon in a stack.

When the printing of the prescribed number of print sheets is completed, the outer peripheral wall 53 of the printing drum is caused to stop rotating, and concurrently the ink supplying mechanism 54 is caused to stop operating. By this, the supplying of ink 56 to the outer peripheral wall 53 is caused to stop. In addition, the pressure roller 35 is caused to return from the pressing position to the resting position, and is brought into a resting mode.

When a mode of discharging a stencil paper is chosen in order to do such as start to make a new stencil paper, the stencil clamping unit 27 of the printing drum 26 is caused to provide displacement to a place in which the clamping is released. Accordingly, the extremity of the stencil paper 18 which has been released from the state of being clamped is guided by the discharged stencil transferring unit 47 in correspondence with the rotation of the printing drum 26, and eventually the stencil paper is contained in the stencil disposal box 48.

According to this stencil printing machine, as described above, ink 56 is supplied onto the outer peripheral wall 53 of the printing drum 26, this ink 56 is caused to disperse over the outer peripheral wall 53 by being squeezed by the pressure of the pressure roller 35. Concurrently, this dispersed ink 56 is transferred, out of pores in the stencil paper 18, onto the print sheet 37 by the pressure of the pressure roller 35. As a consequence, when the printing mode is completed, the ink 56 which has been supplied onto the printing drum 26 is held in a virtually airtight space between the outer peripheral wall 53 of the printing drum 26 and the stencil paper 18, and the exposure of the ink 56 to the atmosphere is minimized. Accordingly, if a printing operation is not performed for a long time, in no case does the ink 56 change in quality, and the ink 56 can be prevented from changing in quality. In addition, unlike conventional examples, various rollers for supplying ink need not be arranged inside the printing drum 26. Thus, this makes it possible to further miniaturize, and to further reduce the weight of, the printing drum 26.

In addition, since the ink supplying unit 55A is arranged in the maximum printing area S of the outer peripheral wall 53 of the printing drum 26, an area for arranging the ink supplying unit 55A need not be additionally assigned outside the maximum printing area S. Accordingly, this contributes to the miniaturizing of the printing drum 26.

Furthermore, since the outer peripheral wall 53 of the printing drum 26 may be made of ink impermeable material, a material for the member can be selected out of a more varied choice. Since, also, the outer peripheral wall 53 may have a simple construction, the outer peripheral wall 53 can be manufactured at lower costs. Moreover, since the strength of the printing drum 26 can be increased easily, unevenness of an image can be prevented from being caused by fluctuations in printing pressure and the like.

Additionally, since the exposure of the ink 56 to the atmosphere is minimized, the ink 56 can be supplied for printing operations in a preferable condition which is virtually free from deterioration of ink quality. As a result, management for preventing ink 56 from deteriorating in quality is not needed, and ink can be selected out of a more varied choice.

According to the first embodiment, the ink supplying unit 55A includes a plurality of ink supplying outlets 55*a* which have openings at equal intervals in the outer peripheral wall 53 in the direction N orthogonal to the printing direction M. Accordingly, while ink 56 is dispersed downstream in the printing direction by the pressure of the pressure roller 35, the ink 56 is evenly dispersed in the direction N orthogonal to the printing direction M. As a consequence, unevenness of print concentration in the direction N orthogonal to the printing direction M can be surely prevented. In this regard, the ink supplying unit 55A may be configured to be arranged in the outer peripheral wall 53 in the direction N orthogonal to the printing direction M, and to be capable of supplying ink 56 nearly evenly in the direction N orthogonal to the printing direction M. This allows various configurations to be practical. For example, if the ink supplying unit 55A is configured to include ink supplying outlets which have openings in series in the outer peripheral wall 53 in the direction N orthogonal to the printing direction M, it also serves for the object of the embodiment.

According to this fist embodiment, since the stencil clamping unit 27 does to stick out of the surface of the outer peripheral wall 53 of the printing drum 26, the pressure roller 35 is caused to operate with ease. In other words, while in a printing mode, the pressure roller 35 need not to be caused to provide displacement between the pressing position and the resting position every time the printing drum 26 is caused to operate for the purpose of avoid the collision of the pressure roller 35 with the stencil clamping unit 27. This makes it possible to solve problems such as noises caused by the pressure roller 35, deteriorated quality in a printed image caused by bumps of the pressure roller 35 and the like.

Figure 11:
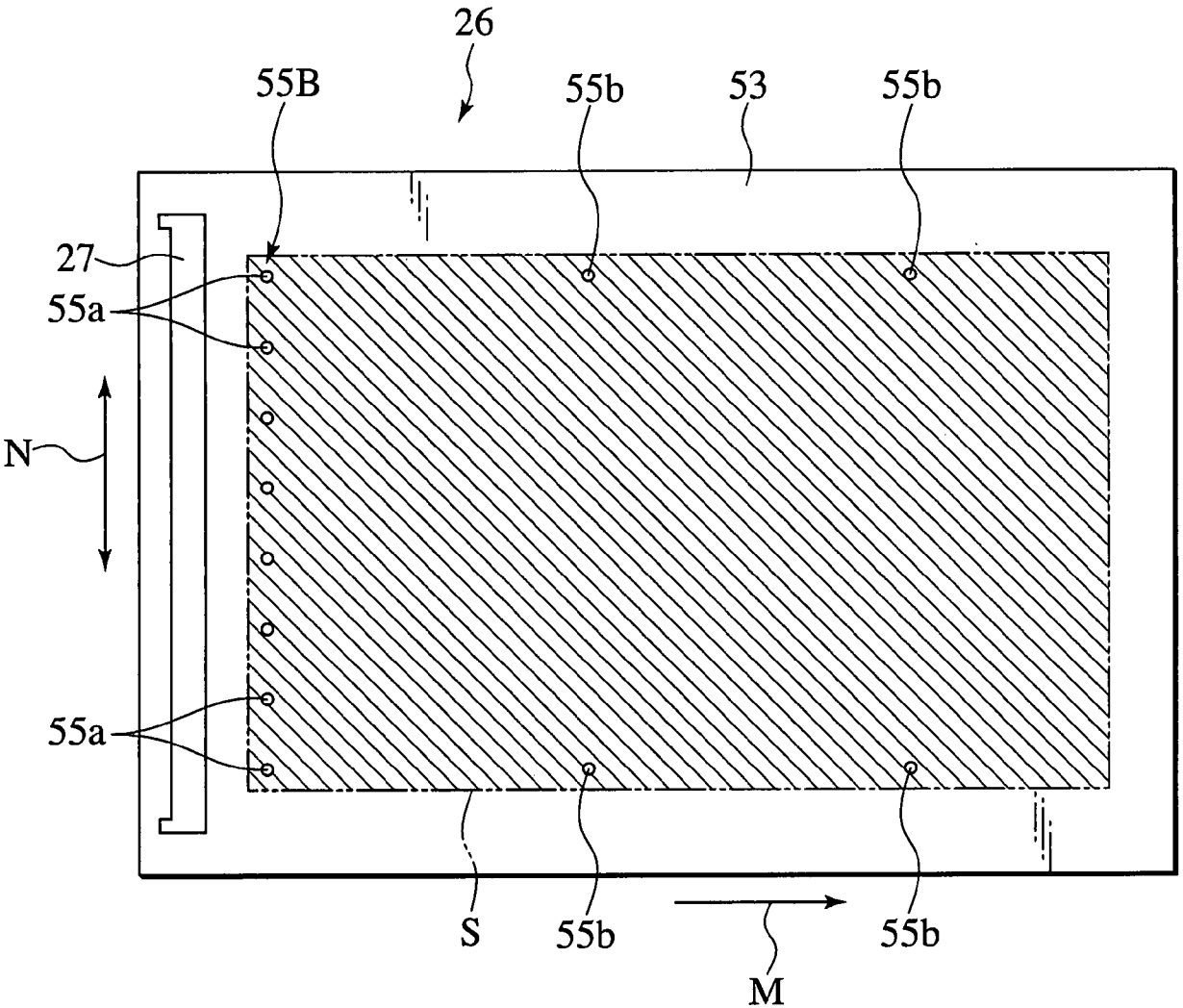
FIG. 11 is an expanded view of an outer peripheral wall of the printing drum to show a first modification of the first embodiment of the present invention.

FIG. 11 shows a first modification of the first embodiment, and is an expanded view of an outer peripheral wall of the printing drum.

As shown in FIG. 11, as in the case of the above described first embodiment, an ink supplying unit 55B comprises: ink supplying outlets 55*a*, which have a constitution similar to that of the first embodiment, in a most upstream position of the printing in the maximum printing area S of the outer peripheral wall 53; and ink supplying outlet 55*b* in the vicinity of both right and left side edges on the downstream of the printing in the maximum printing area S, which is located on the outer peripheral wall 53 of the printing drum 26.

Incidentally, since other configurations are similar to those of the above described first embodiment, detailed descriptions for those configurations will be omitted in order to avoid repeated descriptions.

According to the first modification, while ink is being squeezed downstream by the pressure roller 35, part of the ink is squeezed out of both right and left edges of the maximum printing area S. In some cases, as the ink is squeezed downstream of the maximum printing area S further and further, an amount of ink goes insufficient in both right and left edges. For this reason, ink is configured to be additionally supplied from the vicinity of both side edges on the downstream of the printing. Accordingly, in no case does ink go insufficient in the vicinity of both edges downstream of the printing. As a result, unevenness of print concentration in the direction N orthogonal to the printing direction M can be surely avoided.

Figure 12:
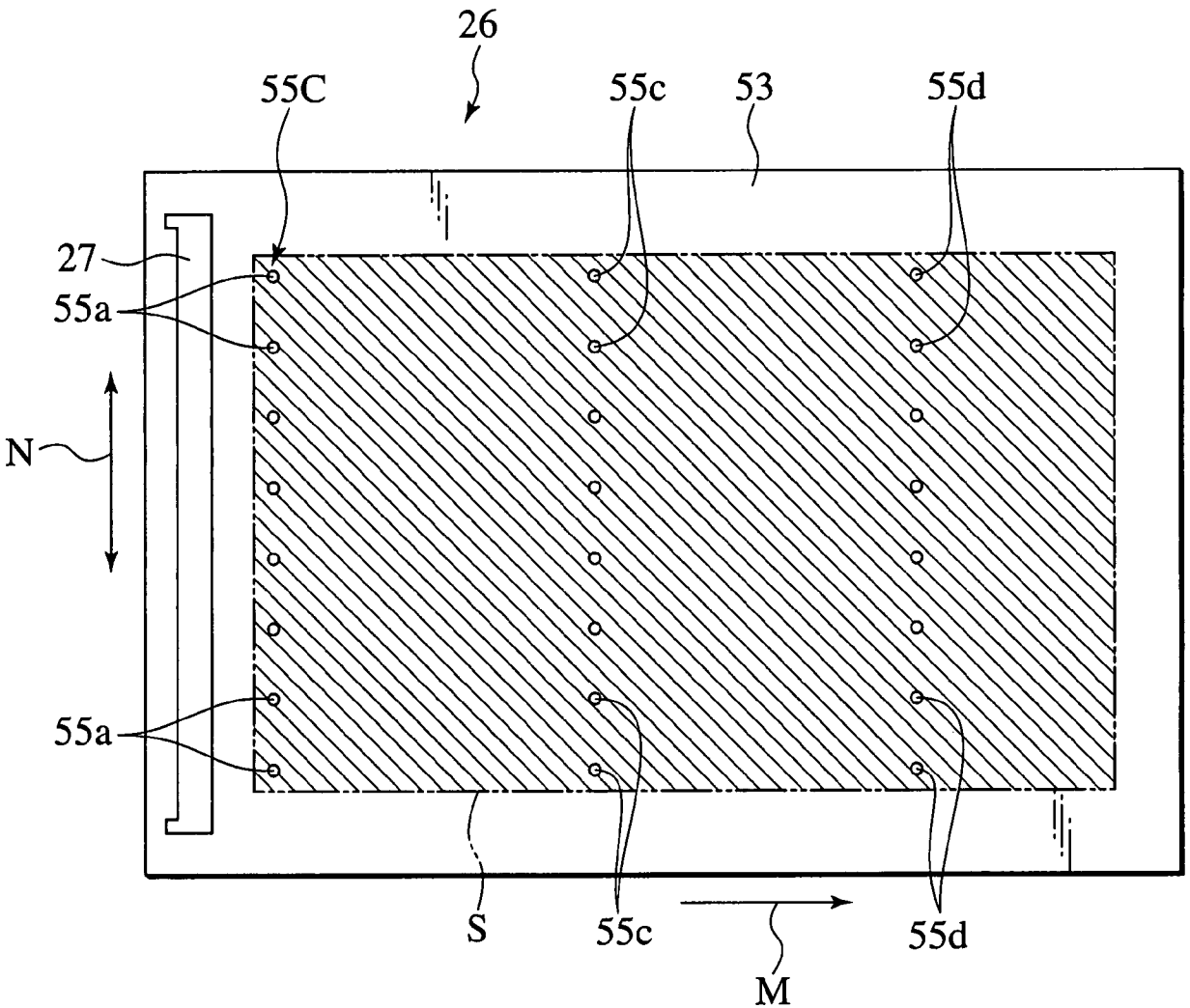
FIG. 12 is an expanded view of an outer peripheral wall of the printing drum to show a second modification of the first embodiment of the present invention.

FIG. 12 shows a second modification of the first embodiment of the present invention, and is an expanded view of the outer peripheral wall of the printing drum.

As shown in FIG. 12, an ink supplying unit 55C includes ink supplying outlets 55*a* in the most upstream position of the printing, which is obtained by dividing the maximum printing area S in the outer peripheral wall 53 of the printing drum 26 into three blocks in the printing direction, and which responds to a place similar to that of the above described first embodiment. The ink supplying unit 55C also include ink supplying outlets 55*c* and 55*d* in the upstream position of the respective two blocks which are located on the downstream of the most upstream block. The ink supplying outlets 55*a*, 55*c* and 55*d* which are arranged in the respective three blocks are constructed to be open in intervals equal to one another in the direction N orthogonal to the printing direction M in the outer peripheral wall 53.

In the second modification, if the ink supplying outlets 55*a*, 55*c* and 55*d*, which are located in the respective three blocks, supply an amount of ink which is needed for use in each block instead of for use in the entire printing area, it serves for the object of the invention. For this reason, a lump of ink, if formed between the stencil paper 18 and the outer peripheral wall 53, could be minimized while the ink is squeezed by the pressure roller 35. As a consequence, load cast on the stencil paper 18 could be reduced, and thus the durability of a stencil paper 18 against repeated use for printing could be improved.

Figure 13:
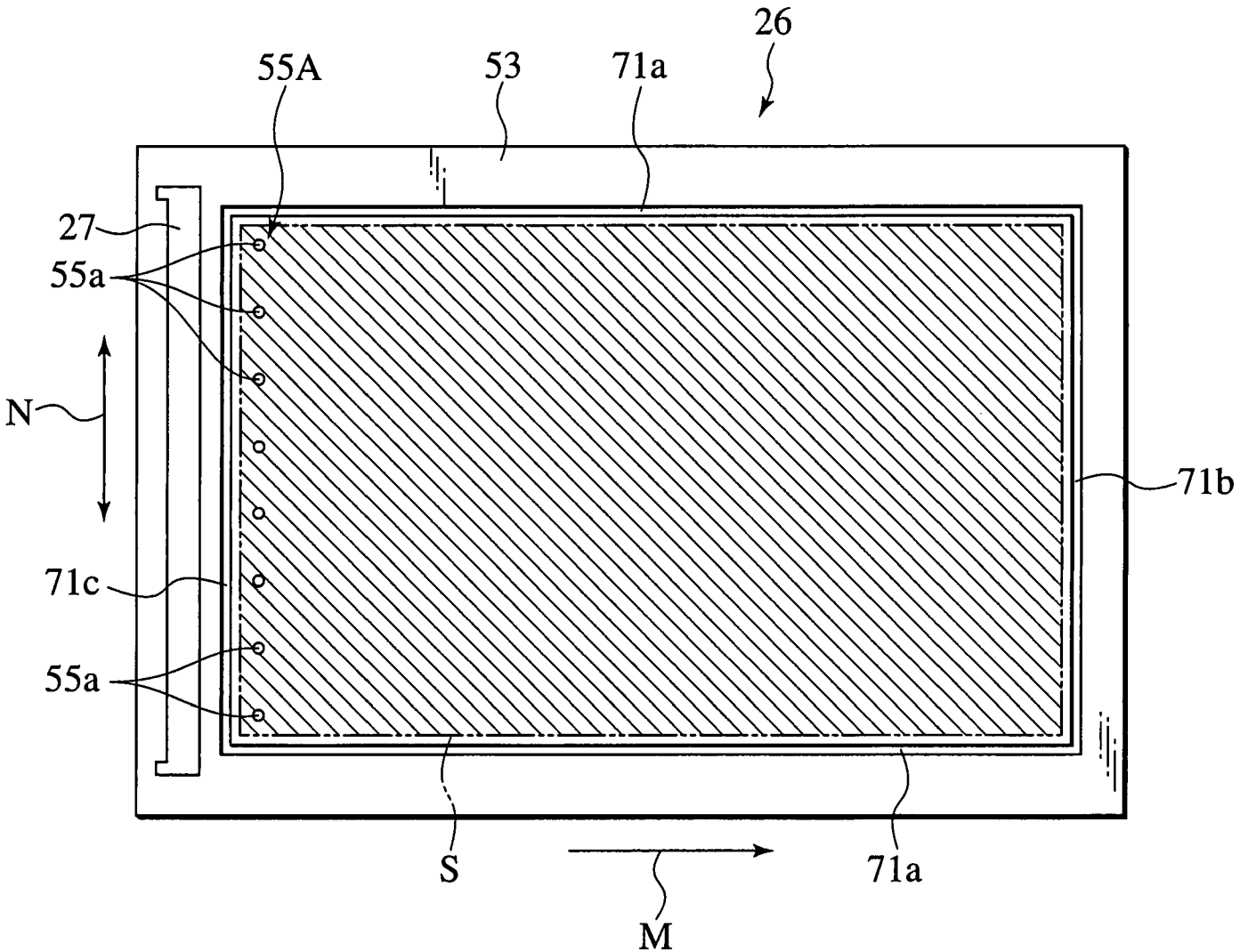
FIG. 13 is an expanded view of an outer peripheral wall of the printing drum to show a third modification of the first embodiment of the present invention.

FIG. 13 shows a third modification of the first embodiment of the present invention, and is an expanded view of the outer peripheral wall of the printing drum.

As shown in FIG. 13, an ink supplying unit 55A which has a constitution similar to that used for the first embodiment is formed in the printing drum 26. Additionally, the grooves 71*a*, 71*b* and 71*c* for preventing ink leak are formed in the surface of the outer peripheral wall 53. The grooves 71*a*, 71*b* and 71*c* for preventing ink leak are placed outside the maximum printing area S, and within a range which the stencil paper 18 covers. The grooves 71*a*, 71*b* and 71*c* for preventing ink leak are constructed to surround the entire outer periphery of the maximum printing area S, as if forming the sides of a rectangle. In other words, an entire groove structure made of the grooves 71*a*, 71*b* and 71*c* for preventing ink leak comprises: the grooves 71*a* for preventing ink leak which are located outside both right and left edges of the maximum printing area S in the direction N orthogonal to the printing direction M, and which are formed to extend on both sides in the printing direction M; the groove 71*b* for preventing ink leak which is located in a position downstream of the maximum printing area S in the printing direction, and which is formed to extend on the end in the direction N orthogonal to the printing direction M; and the groove 71*c* for preventing ink leak which is located in a position upstream of the maximum printing area S but downstream of the stencil clamping unit 27 in the printing direction, and which is formed to extend on the top in the direction N orthogonal to the printing direction M.

According to a third modification, if ink which is held between the outer peripheral wall 53 and the stencil paper 18 leaks out of the maximum printing area S, the leaked ink flows into the grooves 71*a*, 71*b* and 71*c*. Accordingly, the ink can be surely prevented from leaking out of the edges of the stencil paper 18.

Figure 14:
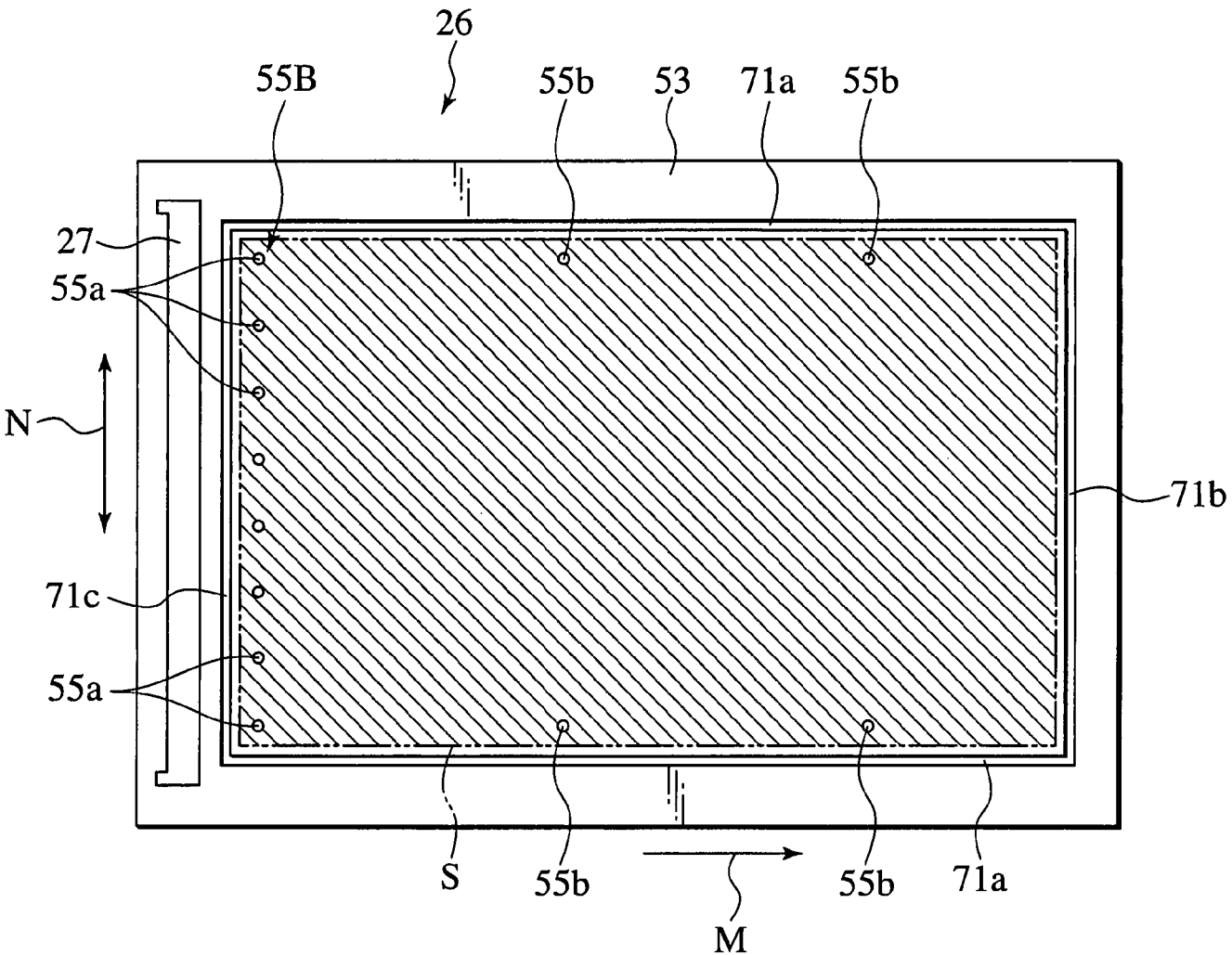
FIG. 14 is an expanded view of an outer peripheral wall of the printing drum to show a fourth modification of the first embodiment of the present invention.

FIG. 14 shows a fourth modification of the first embodiment of the present invention, and is an expanded view of the outer peripheral wall of the printing drum.

As shown in FIG. 14, an ink supplying unit 55B which has a constitution similar to that used for the first modification is formed in the printing drum 26. Grooves 71*a*, 71*b* and 71*c* for preventing ink leak which have a constitution similar to those used for the third modification are formed in the surface of the outer peripheral wall 53.

According to a fourth modification, if ink which is held between the outer peripheral wall 53 and the stencil paper 18 leaks out of the maximum printing area S, the leaked ink flows into the grooves 71*a*, 71*b* and 71*c*, as in the case of the third modification. Accordingly, the ink can be surely prevented from leaking out of the edges of the stencil paper 18.

Figure 15:
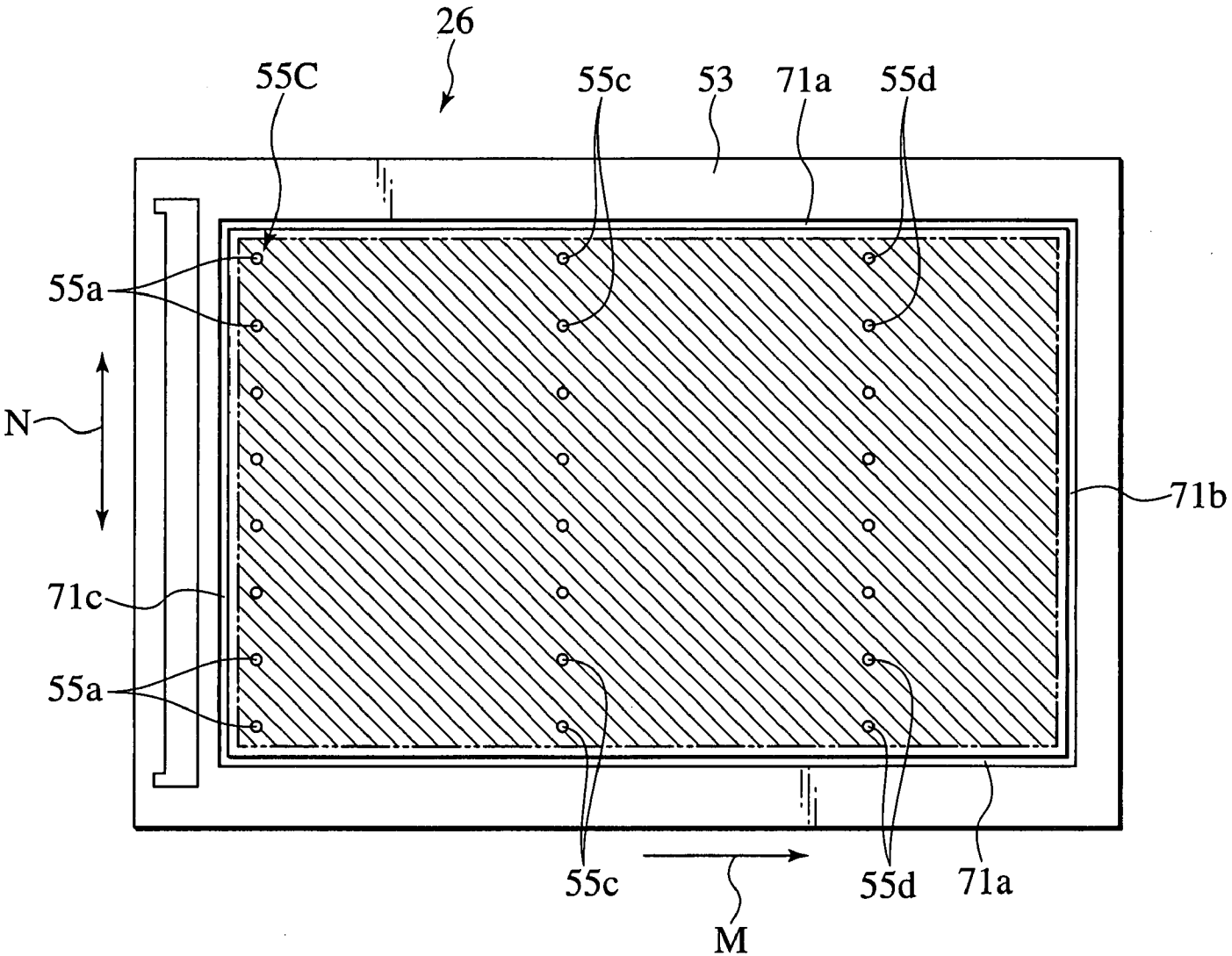
FIG. 15 is an expanded view of an outer peripheral wall of the printing drum to show a fifth modification of the first embodiment of the present invention.

FIG. 15 shows a fifth modification of the first embodiment, and is an expanded view of the outer peripheral wall of the printing drum.

As shown in FIG. 15, an ink supplying unit 55C which has a constitution similar to that used for the second modification is formed in the printing drum 26. Additionally, the grooves 71*a*, 71*b* and 71*c* for preventing ink leak which have a constitution similar to those used for the third modification are formed in the surface of the outer peripheral wall 53.

According to a fifth modification, if ink which is held between the outer peripheral wall 53 and the stencil paper 18 leaks out of the maximum printing area S, the leaked ink flows into the grooves 71*a*, 71*b* and 71*c* for preventing ink leak, as in the case of the third modification. Accordingly, the ink can be surely prevented from leaking out of the edges of the stencil paper 18.

According to the third, fourth and fifth modifications, the grooves 71*a*, 71*b* and 71*c* for preventing ink leak are constructed to surround the entire outer periphery of the maximum printing area, as if forming the sides of a rectangle. Even if the grooves are constructed only in a part of the outer periphery of the maximum printing area S, it serves for the object of the embodiment. In other words, the construction includes only the grooves 71*a* for preventing ink leak which are located in the sides, or only the groove 71*b* for preventing ink leak which is located in the end, or only the groove 71*c* for preventing ink leak which is located in the top, or only a combination of each two of the grooves for preventing ink leak. If the grooves 71*a* for preventing ink leak which are located in the sides are formed, ink leak from both sides of the printing drum 26 can be prevented. If the groove 71*b* which is located in the end is formed, ink leak from the end of the printing drum can be prevented. If the grooves 71*c* which is located in the top is formed, ink leak from the top of the printing drum can be prevented.

Figure 16:
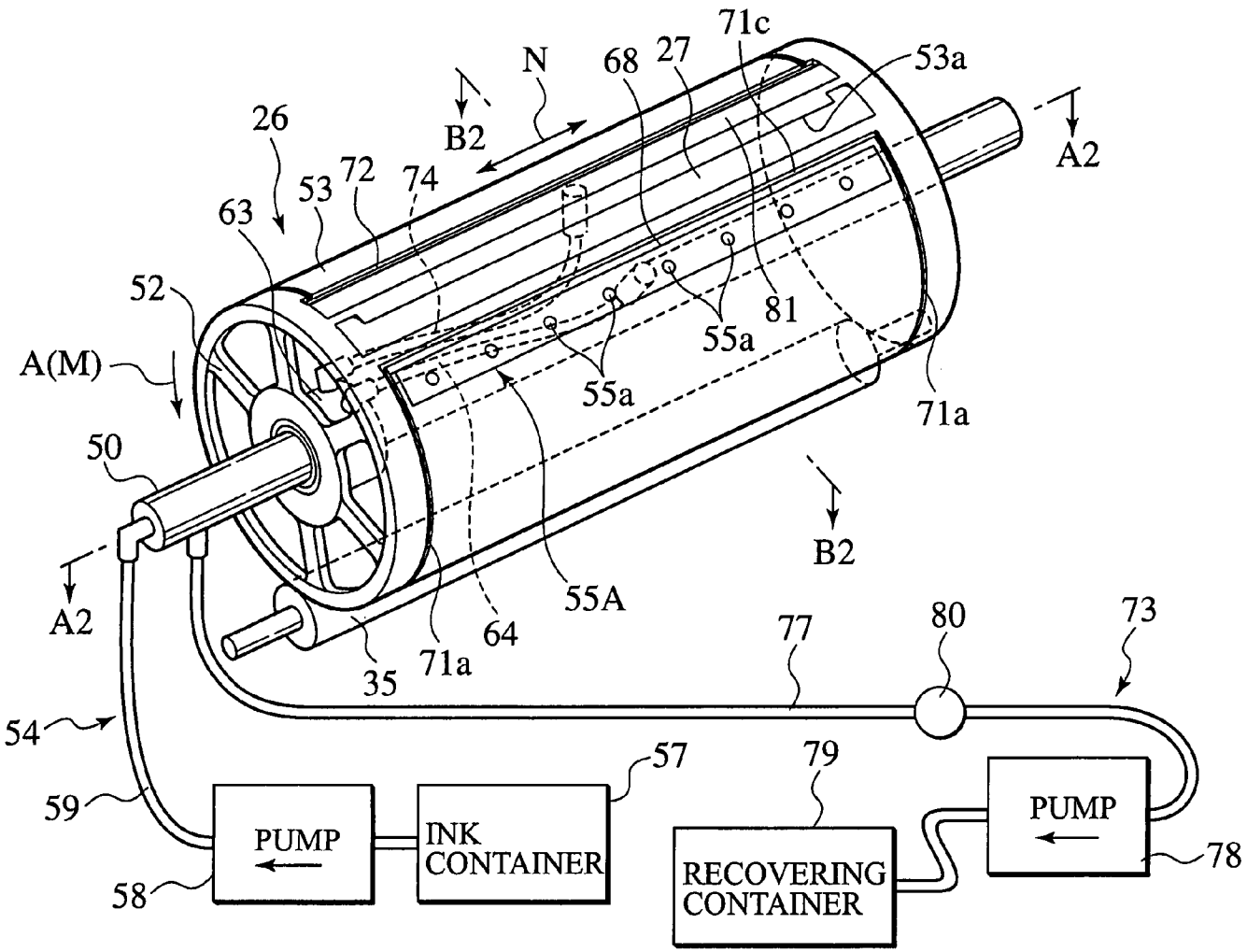
FIG. 16 is a perspective view of a printing drum to show a second embodiment of the present invention.
Figure 17:
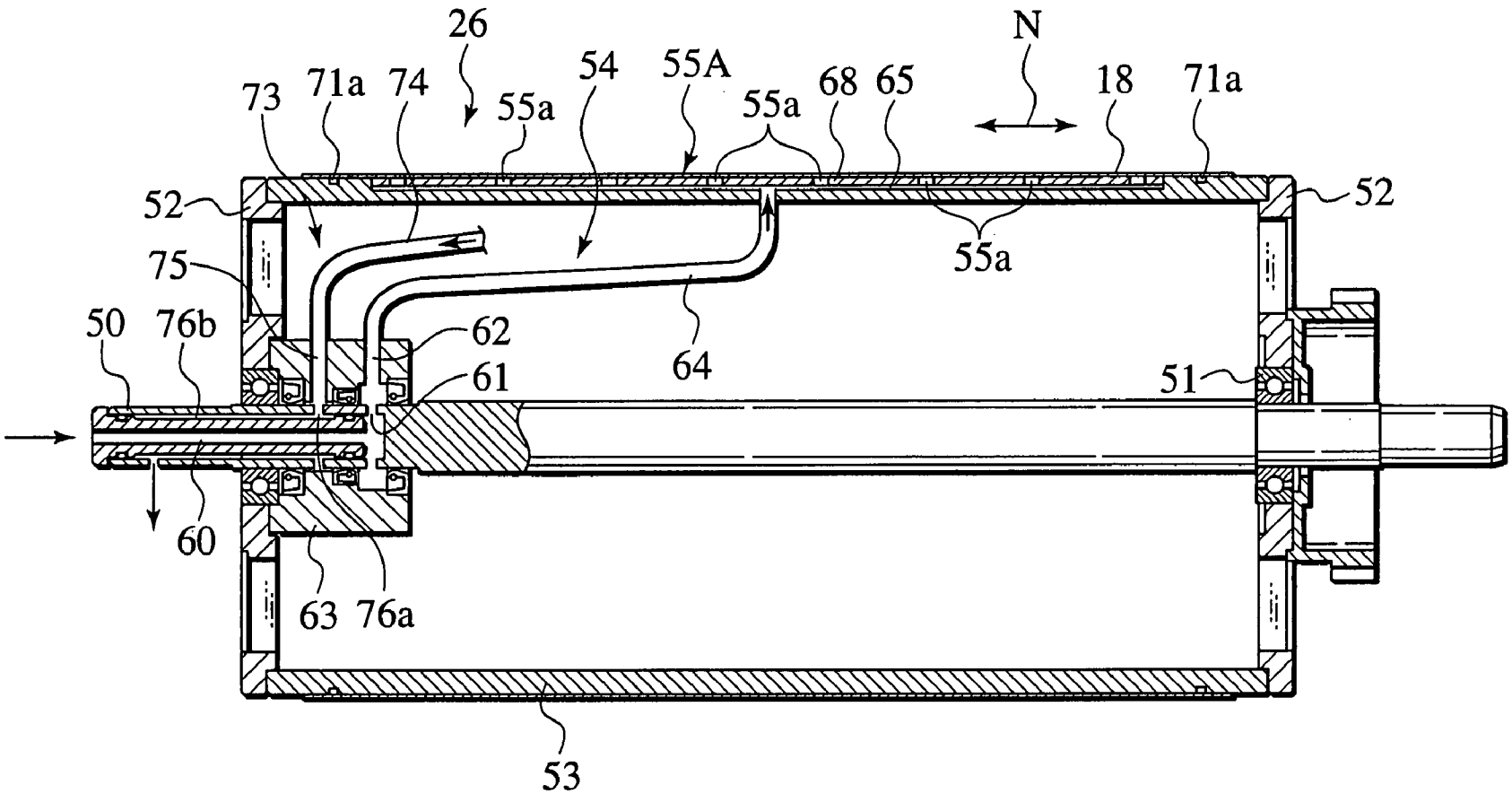
FIG. 17 is a cross sectional view taken along the line 17—17 of FIG. 16 to show the second embodiment of the present invention.
Figure 18:
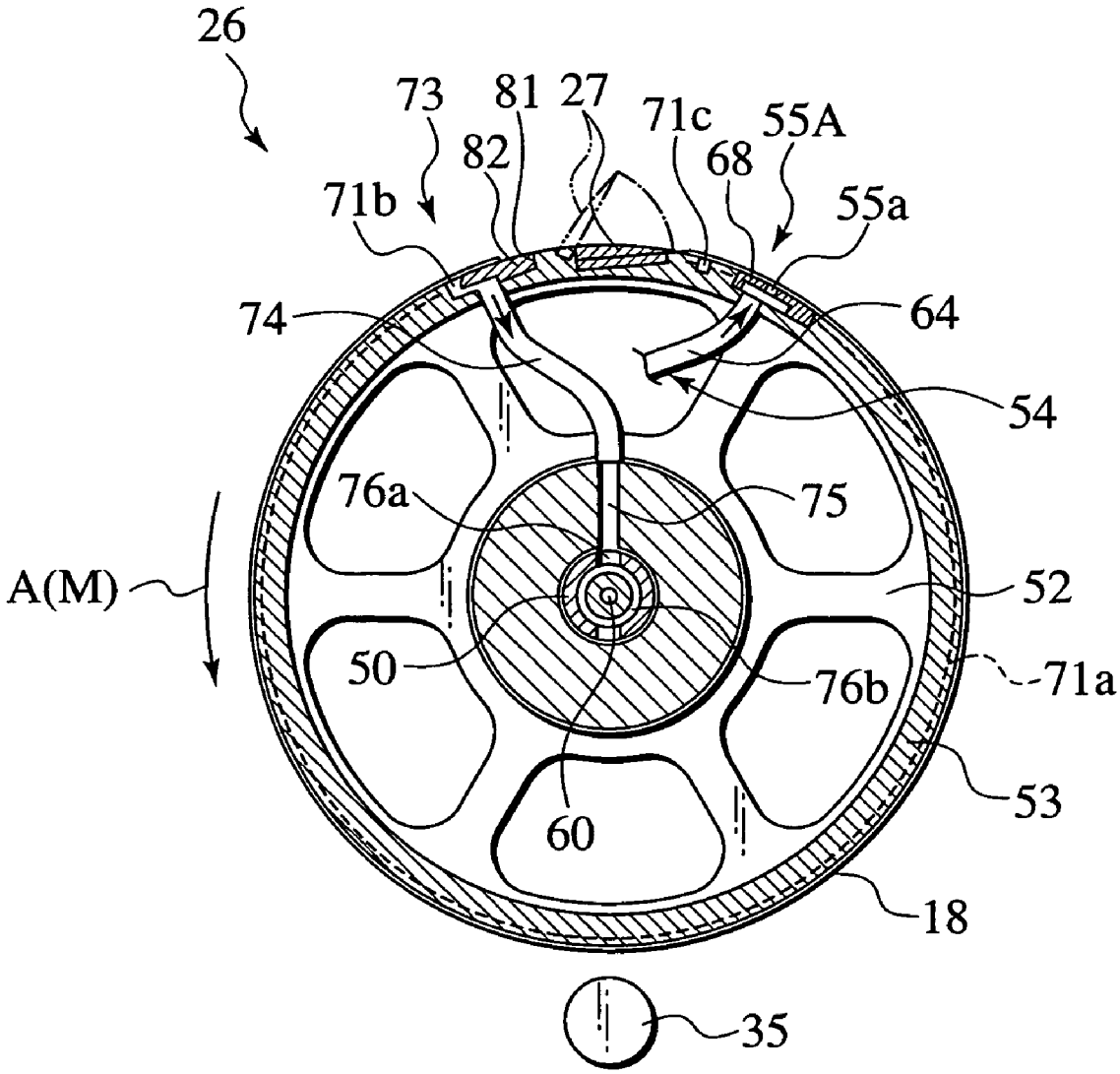
FIG. 18 is a cross sectional view taken along the line 18—18 of FIG. 16 to show the second embodiment of the present invention.
Figure 19:
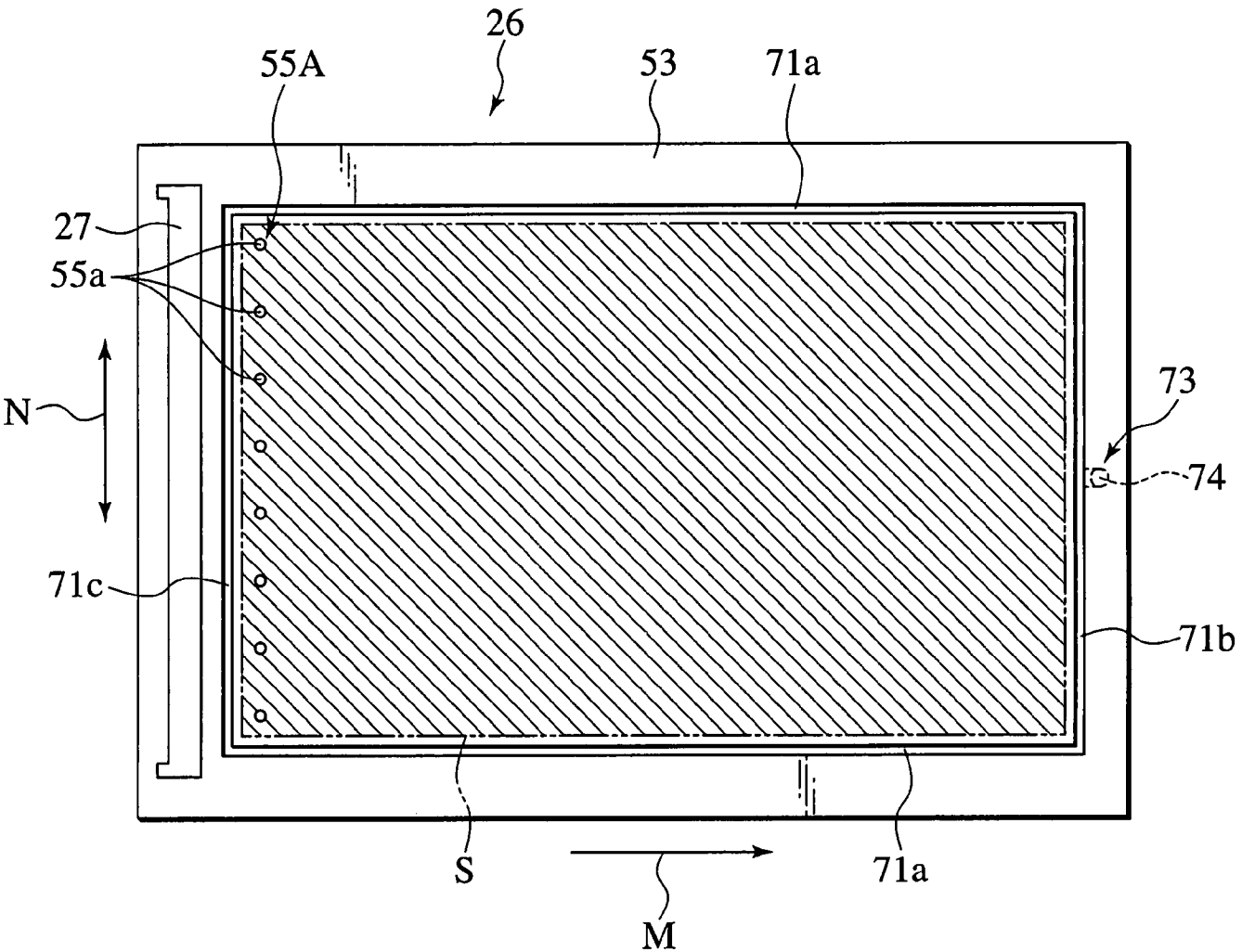
FIG. 19 is an expanded view of an outer peripheral wall of the printing drum to show the second embodiment of the present invention.

FIG. 16 to FIG. 19 show a second embodiment of the present invention. FIG. 16 is a perspective view of the printing drum. FIG. 17 is a cross sectional view taken along the line 17—17 of FIG. 16. FIG. 18 is a cross sectional view taken along the line 18—18 of FIG. 16. FIG. 19 is an expanded view of the outer peripheral wall of the printing drum.

As shown in FIG. 16 to FIG. 17, in the second embodiment, grooves 71*a*, 71*b* and 71*c* for preventing ink leak are formed in the surface of the outer peripheral wall 53 of the printing drum 26, and an ink recovering mechanism 73 for recovering ink which leaks out of the maximum printing area S of the outer peripheral wall 53 is added, in comparison with the above described first embodiment.

The ink recovering mechanism 73 uses the grooves 71*a*, 71*b* and 71*c* for preventing ink leak which have a constitution similar to those of the third, fourth and fifth modifications of the first embodiment as grooves for recovering ink. The ink recovering mechanism 73 comprises: a third pipe 74, one end of which is open to the groove 71*b* for preventing ink leak; the rotary joint 63, which the other end of the third pipe 74 is connected to, and which a communicating hole 75 is formed in; the main shaft 50, by which the rotary joint 63 is supported so as to be capable of being rotated, where a hole 76*a* with which the communicating hole 75 can communicate is formed, and in whose interior an ink passage 76*b* is formed; a fourth pipe 77, one end of which is connected to the main shaft 50; a filter 80 which collects paper dust and the like which is placed in the middle of the fourth pipe 77; an inking pump 78 (e.g. a trochoid pump), which is placed in the middle of the fourth pipe 77, and which sucks up the ink which stays in the fourth pipe 77; and a recovering container 79, to which the other end of the fourth pipe 77 is connected.

Since one end of the third pipe 74 is connected to the groove 71*b* for preventing ink from leaking, the groove 71*b* is constructed by use of a concave portion 81 for recovering ink which is formed in the outer peripheral wall 53 and a pipe fixing member 82 which is arranged inside the concave portion 81 for recovering ink, instead of merely forming a concave portion in the surface of the outer peripheral wall 53. The rotary joint 63 is also used for the ink supplying mechanism 54. Since the main shaft 50 is also used for the ink passage of the ink supplying mechanism 54, the main shaft 50 is constructed of a double pipe.

Incidentally, since other constitutions are the same as those of the above described first embodiment, the same components are furnished with the same reference numerals and symbols, and detailed description is omitted.

In the second embodiment, too, ink 56 will not change in quality even if a printing operation has not been performed for a long time, as in the case of the first embodiment. In addition, the printing drum can be miniaturized, and the weight thereof can be reduced.

In the second embodiment, the ink recovering mechanism 73 for recovering ink which leaks out of the maximum printing area S of the outer peripheral wall 53 is provided. Accordingly, an excessive amount of ink can be removed from the outer peripheral wall 53 of the printing drum 26, and concurrently can be recycled. In addition, ink which has been pooled in the grooves 71*a*, 71*b* and 71*c* for preventing ink leak can be recovered, a situation in which ink overflows from the grooves 71*a*, 71*b* and 71*c* for preventing ink leak can be avoided.

In the second embodiment, the ink container 57 for supplying ink and the recovering container 79 for recovering ink are provided. For this reason, recovered ink may not necessarily be recycled.

In the second embodiment, the filter 80 is placed in the middle of the fourth pipe 77 of the ink recovering mechanism 73, and thus ink 56 which is not contaminated with paper dust can be surely returned to the recovering container 79 without being adulterated. This contributes to improving the quality of recycled ink. The ink filter 80, however, is not an essential item for recycling ink. An embodiment without the filter provided can be also acceptable.

In the second embodiment, if control is made so as to cause the ink supplying mechanism 54 and ink recovering mechanism 73 to always operate while in a printing mode, ink is supplied uninterruptedly from the ink supplying unit 55A to the outer peripheral wall 53 while in a printing mode, and thus ink which flows from the outer peripheral wall 53 into the grooves 71*a*, 71*b* and 71*c* for preventing ink leak is always recovered. This prevents ink from remaining on the outer peripheral wall 53 as much as possible. In addition, an adequate amount of ink can be always held on the outer peripheral wall 53. Accordingly, even when a large quantity of printing is performed in succession, printed sheets which are prepared with a desired concentration of ink can be available.

Incidentally, the ink recovering mechanism 73 of the second embodiment uses the grooves 71*a*, 71*b* and 71*c* for preventing ink leak as grooves for recovering ink. It should be noted, however, that ink recovering grooves may be constructed in a place other than the place in which the grooves 71*a*, 71*b* and 71*c* for preventing ink leak are arranged, preferably in a place outside the place in which the grooves 71*a*, 71*b* and 71*c* for preventing ink leak are arranged. Otherwise, only ink recovering grooves may be constructed instead of constructing the grooves 71*a*, 71*b* and 71*c* for preventing ink leak.

Figure 20:
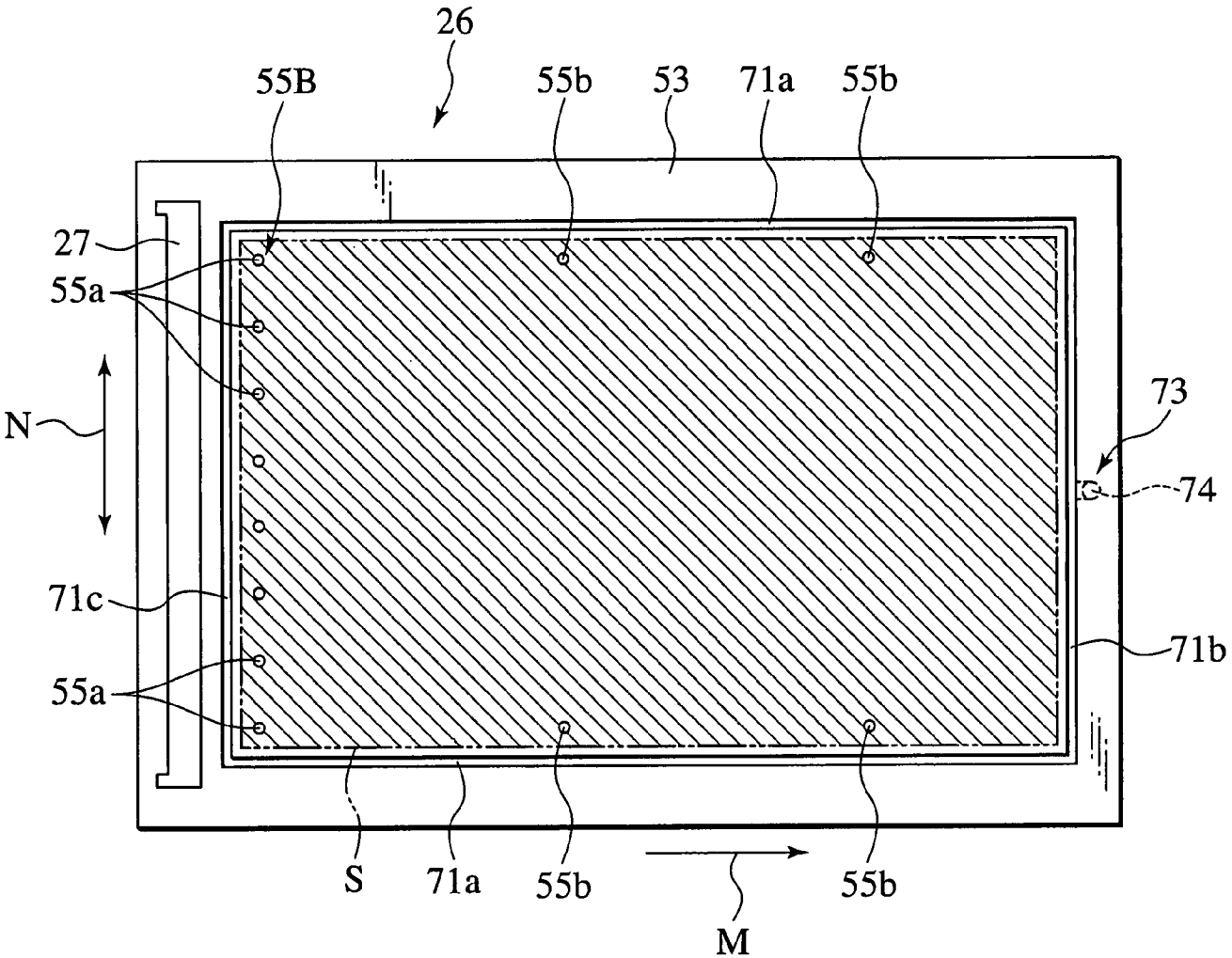
FIG. 20 is an expanded view of an outer peripheral wall of the printing drum to show a first modification of the second embodiment of the present invention.

FIG. 20 shows a first modification of the second embodiment, and is an expanded view of the outer peripheral wall of the printing drum.

As shown in FIG. 20, the ink supplying unit 55B includes ink supplying outlets 55*a* which has a constitution similar to that of the above described second embodiment in a most upstream position of the printing in the maximum printing area S of the outer peripheral wall 53. In addition, the ink supplying unit 55B includes ink supplying outlet 55*b* in the vicinity of both right and left side edges on the downstream of the printing places in the maximum printing area, which is located on the outer peripheral wall 53 of the printing drum 26. In other words, the first modification of the second embodiment has a constitution similar to that of the first modification of the first embodiment.

Incidentally, since other constitutions are the same as those of the above described second embodiment, and detailed description is omitted in order to avoid repeated description.

According to the first modification, while ink is being squeezed through in-between downstream by the pressure roller 35, part of the ink is squeezed out of both right and left side edges of the maximum printing area S. In some cases, as the ink is squeezed through in-between downstream of the maximum printing area S further and further, an amount of ink goes insufficient in both right and left edges. For this reason, ink is configured to be additionally supplied from the vicinity of both edges downstream of the printing. Accordingly, in no case does ink go insufficient in the vicinity of both edges downstream. As a result, unevenness of print concentration in the direction N orthogonal to the printing direction M can be surely avoided.

Figure 21:
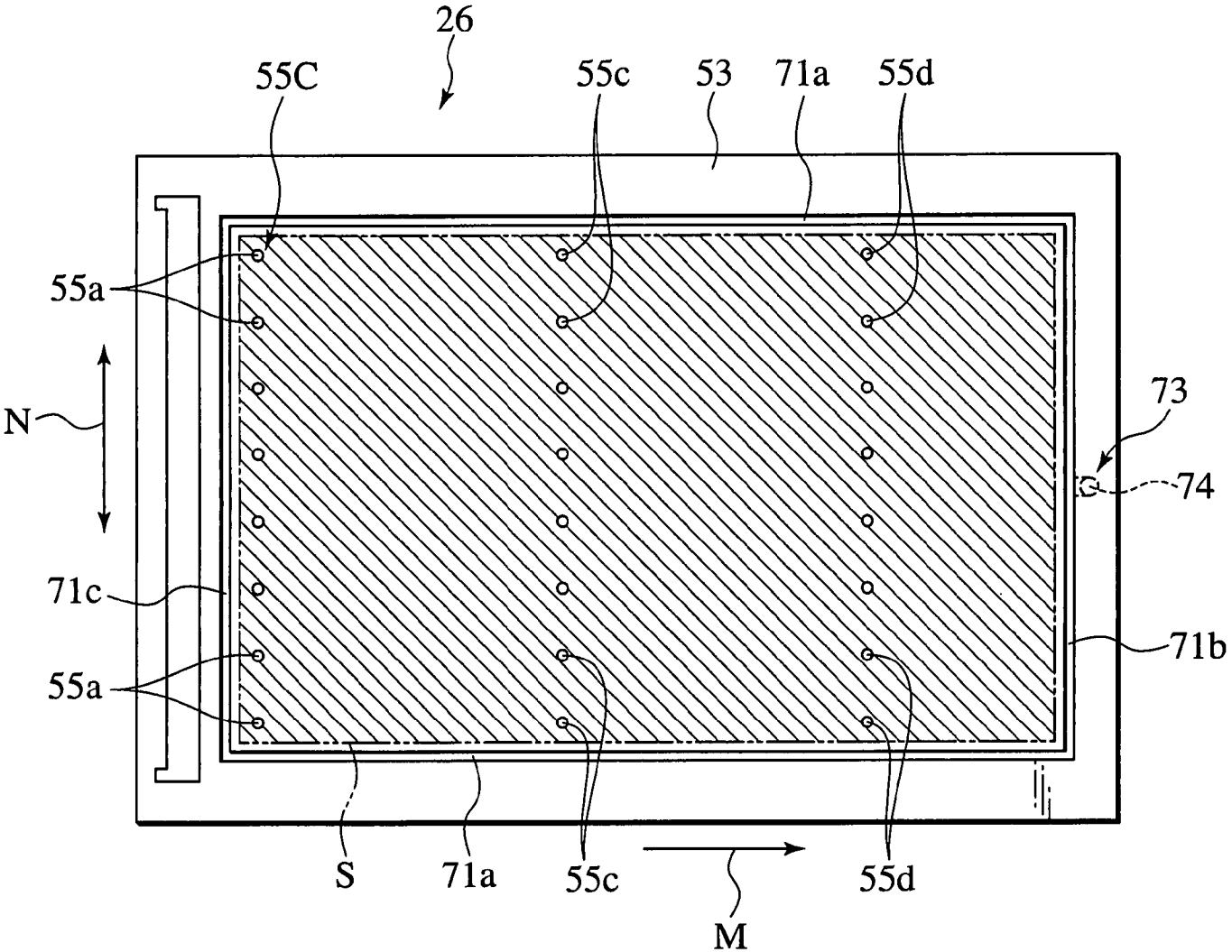
FIG. 21 is an expanded view of an outer peripheral wall of the printing drum to show a second modification of the second embodiment of the present invention.

FIG. 21 shows a second modification of the second embodiment of the present invention, and is an expanded view of the outer peripheral wall of the printing drum.

As shown in FIG. 21, an ink supplying unit 55C includes ink supplying outlets 55*a* in the most upstream position of the printing, which is obtained by dividing the maximum printing area S in the outer peripheral wall 53 of the printing drum 26 into three blocks in the printing direction, and which responds to a place similar to that of the above described first embodiment. The ink supplying unit 55C also include ink supplying outlets 55*c* and 55*d* in the upstream position of the respective two blocks which are located downstream of the most upstream block. The ink supplying outlets 55*a*, 55*c* and 55*d* which are arranged in the respective three blocks are constructed to be open in intervals equal to one another in the direction N orthogonal to the printing direction M in the outer peripheral wall 53. In other words, the second modification of the second embodiment has a constitution similar to that used for the second modification of the first embodiment.

In the second modification, if the ink supplying outlets 55*a*, 55*c* and 55*d*, which are located in the respective three blocks, supply an amount of ink which is used for the block instead of an amount of ink which is used for the overall printing area, it serves for the object of the embodiment. For this reason, a lump of ink can be minimized even if the lump of ink is formed between the stencil paper 18 and the outer peripheral wall 53 while the ink is squeezed through in-between by the pressure roller 35. As a consequence, load cast on the stencil paper 18 could be reduced, and thus the durability of the stencil paper 18 against repeated printing can be improved.

What is claimed is:

1. A stencil printing machine, comprising:

a rotatable printing drum including an outer peripheral wall of ink impermeable material, wherein a stencil paper is mounted on the surface of the outer peripheral wall;

an ink supplying mechanism including an ink supplying unit in a maximum printing area of the outer peripheral wall of the printing drum configured to supply ink from the ink supplying unit to the surface of the outer peripheral wall, the ink supplying unit including ink supplying outlets which have openings arranged on a most upstream position in the maximum printing area of the outer peripheral wall; and a pressure roller configured to press a fed print medium against the outer peripheral wall.

2. The stencil printing machine according to claim 1, wherein the ink supplying unit is arranged on the outer peripheral wall in the direction orthogonal to the printing direction, and supplies ink almost evenly in the direction orthogonal to the printing direction.

3. The stencil printing machine according to claim 1, wherein the ink supplying unit is arranged in the vicinity of both side edges of the maximum printing area in the printing direction on the outer peripheral wall of the printing drum.

4. The stencil printing machine according to claim 1, wherein a groove for preventing ink leak is arranged on the outer peripheral wall, outside the maximum printing area and in a place covered by the stencil paper.

5. The stencil printing machine according to claim 4, further comprising an ink recovering mechanism configured to recover ink leaked out of the maximum printing area of the outer peripheral wall.

6. The stencil printing machine according to claim 5, wherein the ink recovering mechanism recovers ink accumulated in the groove for preventing ink leak.

7. The stencil printing machine according to claim 1, wherein the ink supplying unit is configured to supply ink between the stencil paper and the surface of the outer periphery wall from the inside of the printing drum without exposing the ink to the atmosphere.

8. The stencil printing machine according to claim 1, wherein the ink supplying mechanism includes a conduit configured to supply ink to the ink supplying unit from the inside of the printing drum without exposing the ink to the atmosphere.

9. The stencil printing machine according to claim 1, wherein the ink supplying unit including a plurality of ink supplying outlets which have openings in the outer peripheral wall downstream of a printing direction in the maximum printing area.

10. A stencil printing machine, comprising:

a rotatable printing drum including an outer peripheral wall of ink impermeable material, wherein a stencil paper is mounted on the surface of the outer peripheral wall;

an ink supplying mechanism including an ink supplying unit in a maximum printing area of the outer peripheral wall of the printing drum, configured to supply ink from the ink supplying unit to the surface of the outer peripheral wall; and a pressure roller configured to press a fed print medium against the outer peripheral wall, wherein the ink supplying unit is arranged on an upstream position in each of a plurality of blocks on the outer peripheral wall of the printing drum, the blocks obtained by dividing the maximum printing area in the printing direction.

* * * * *